US009713211B2

(12) United States Patent
van de Ven et al.

(10) Patent No.: US 9,713,211 B2
(45) Date of Patent: Jul. 18, 2017

(54) SOLID STATE LIGHTING APPARATUS WITH CONTROLLABLE BYPASS CIRCUITS AND METHODS OF OPERATION THEREOF

(75) Inventors: Antony P. van de Ven, Hong Kong (HK); Gerald H. Negley, Chapel Hill, NC (US); Michael James Harris, Cary, NC (US); Paul Kenneth Pickard, Morrisville, NC (US); Joseph Paul Chobot, Morrisville, NC (US); Terry Given, Papakura (NZ)

(73) Assignee: Cree, Inc., Durham, NC (US)

( * ) Notice: Subject to any disclaimer, the term of this patent is extended or adjusted under 35 U.S.C. 154(b) by 221 days.

(21) Appl. No.: 12/566,195

(22) Filed: Sep. 24, 2009

(65) Prior Publication Data

US 2011/0068702 A1 Mar. 24, 2011

(51) Int. Cl.
*H05B 41/36* (2006.01)
*H05B 33/08* (2006.01)

(52) U.S. Cl.
CPC ..... *H05B 33/083* (2013.01); *H05B 33/0854* (2013.01)

(58) Field of Classification Search
USPC ..... 315/209 R, 88, 89, 90, 93, 91, 119, 121, 315/122, 123, 125, 127, 128, 185 R, 186, 315/192, 193, 185 S, 210, 217, 224, 225, 315/226, 291, 294, 295, 297, 299, 300, 315/301, 306–313, 320, 317, 318, 319, 315/322, 323, 362, 361
See application file for complete search history.

(56) References Cited

U.S. PATENT DOCUMENTS

| | | | |
|---|---|---|---|
| 446,142 | A | 2/1891 | Martin |
| D188,916 | S | 9/1960 | Harling |
| D207,867 | S | 6/1967 | Pettengill |
| 3,560,728 | A | 2/1971 | Atkin |
| 3,638,042 | A | 1/1972 | Studtmann |
| 3,655,988 | A | 4/1972 | Nakamura et al. |

(Continued)

FOREIGN PATENT DOCUMENTS

| | | | |
|---|---|---|---|
| CN | 1575623 | A | 2/2005 |
| CN | 1863423 | A | 11/2006 |

(Continued)

OTHER PUBLICATIONS

International Search Report Corresponding to International Application No. PCT/US2012/040189; Date of Mailing: Aug. 20, 2012; 15 Pages.

(Continued)

*Primary Examiner* — Douglas W Owens
*Assistant Examiner* — Jianzi Chen
(74) *Attorney, Agent, or Firm* — Myers Bigel, P.A.

(57) ABSTRACT

A lighting apparatus includes a string with a plurality of serially-connected light emitting device sets, each set comprising at least one light emitting device. The apparatus further includes at least one controllable bypass circuit configured to variably bypass current around at least one light emitting device of a set of the plurality of light emitting device sets responsive to a control input. The control input may include, for example, a temperature input, a string current sense input and/or an adjustment input. The control input may be varied, for example, to adjust a color point of the string.

37 Claims, 21 Drawing Sheets

(56) References Cited

U.S. PATENT DOCUMENTS 3,755,697 A 8/1973 Miller
3,787,752 A 1/1974 Delay
3,913,098 A 10/1975 Nakamura et al.
4,090,189 A 5/1978 Fisler
4,504,776 A 3/1985 Haville
4,717,868 A 1/1988 Peterson
4,743,897 A 5/1988 Perez
4,798,983 A 1/1989 Mori
4,839,535 A 6/1989 Miller
4,841,422 A 6/1989 Groh
4,918,487 A 4/1990 Coulter, Jr.
5,059,788 A 10/1991 Tashiro et al.
5,059,890 A 10/1991 Yoshikawa et al.
5,125,675 A 6/1992 Engelbrecht
5,138,541 A 8/1992 Kano
5,151,679 A 9/1992 Dimmick
5,175,528 A 12/1992 Choi et al.
5,334,916 A 8/1994 Noguchi
5,345,167 A 9/1994 Hasegawa et al.
5,357,120 A 10/1994 Mori
5,384,519 A 1/1995 Gotoh
5,397,938 A 3/1995 Wilhelm et al.
5,467,049 A 11/1995 Kida et al.
5,504,448 A 4/1996 Bennett et al.
5,521,708 A 5/1996 Beretta
5,528,467 A 6/1996 Jiang
5,598,068 A 1/1997 Shirai
5,631,190 A 5/1997 Negley
5,646,760 A 7/1997 Kuijk et al.
5,661,645 A 8/1997 Hochstein
D384,430 S 9/1997 Lecluze
5,736,881 A 4/1998 Ortiz
5,798,520 A 8/1998 Kuijk et al.
5,803,579 A 9/1998 Turnbull et al.
D400,280 S 10/1998 Leen
5,844,377 A 12/1998 Anderson et al.
5,912,477 A 6/1999 Negley
5,912,568 A 6/1999 Kiley
5,929,568 A 7/1999 Eggers
D418,620 S 1/2000 Grossman
D425,024 S 5/2000 Klaus et al.
6,079,852 A 6/2000 Kamaya et al.
6,137,235 A 10/2000 Franck
6,150,771 A 11/2000 Perry
6,153,980 A 11/2000 Marshall et al.
6,161,910 A 12/2000 Reisenauer et al.
D437,439 S 2/2001 Tang
6,201,353 B1 3/2001 Chang et al.
6,222,172 B1 4/2001 Fossum et al.
6,264,354 B1 7/2001 Motilal
6,285,139 B1 9/2001 Ghanem
6,323,597 B1 11/2001 Janning
6,329,760 B1 12/2001 Bebenroth
6,329,764 B1 12/2001 van de Ven
6,340,868 B1 1/2002 Lys et al.
6,350,041 B1 2/2002 Tarsa et al.
6,362,578 B1 3/2002 Swanson et al.
6,388,393 B1 5/2002 Illingworth
6,396,718 B1 5/2002 Ng et al.
6,400,101 B1 6/2002 Biebl et al.
6,411,155 B2 6/2002 Pezzani
6,441,558 B1 8/2002 Muthu et al.
6,498,440 B2 12/2002 Stam et al.
6,501,630 B1 12/2002 Colclaser et al.
6,515,434 B1 2/2003 Biebl
6,528,954 B1 3/2003 Lys et al.
6,556,067 B2 4/2003 Henry
6,577,072 B2 6/2003 Saito et al.
6,586,890 B2 7/2003 Min et al.
6,600,175 B1 7/2003 Baretz et al.
6,614,358 B1 9/2003 Hutchison et al.
6,630,801 B2 10/2003 Schuurmans
6,636,003 B2 10/2003 Rahm et al.
6,697,130 B2 2/2004 Weindorf et al.
6,724,376 B2 4/2004 Sakura et al.
D490,181 S 5/2004 Redfern
6,747,420 B2 6/2004 Barth et al.
6,753,661 B2 6/2004 Muthu et al.
6,755,550 B1 6/2004 Lackey
6,781,329 B2 8/2004 Mueller et al.
6,784,622 B2 8/2004 Newman, Jr. et al.
6,788,011 B2 9/2004 Mueller et al.
6,791,840 B2 9/2004 Chun
6,808,287 B2 10/2004 Lebens et al.
6,836,081 B2 12/2004 Swanson et al.
6,841,947 B2 1/2005 Berg-johansen
6,864,641 B2 3/2005 Dygert
6,873,203 B1 3/2005 Latham, II et al.
6,885,035 B2 4/2005 Bhat et al.
6,897,624 B2 5/2005 Lys et al.
6,987,787 B1 1/2006 Mick
6,995,518 B2 2/2006 Havlik et al.
6,998,594 B2 2/2006 Gaines et al.
7,014,341 B2 3/2006 King et al.
7,038,399 B2 5/2006 Lys et al.
7,067,995 B2 6/2006 Gunter et al.
7,071,762 B2 7/2006 Xu et al.
7,081,722 B1 7/2006 Huynh et al.
7,088,059 B2 8/2006 Mckinney et al.
7,091,874 B2 8/2006 Smithson
7,108,238 B2 9/2006 Gauci
7,109,664 B2 9/2006 Wu
7,119,498 B2 10/2006 Baldwin et al.
7,144,140 B2 12/2006 Sun et al.
7,161,313 B2 1/2007 Piepgras et al.
7,180,487 B2 2/2007 Kamikawa et al.
7,202,608 B2 4/2007 Robinson et al.
7,213,940 B1 5/2007 Van de Ven et al.
7,218,056 B1 5/2007 Harwood
D544,979 S 6/2007 Hartmann et al.
7,233,831 B2 6/2007 Blackwell
7,245,089 B2 7/2007 Yang
7,271,545 B2 9/2007 Hu et al.
7,291,983 B2 11/2007 Hu et al.
D557,853 S 12/2007 Sandell
D558,374 S 12/2007 Sandell
7,307,391 B2 12/2007 Shan
7,344,275 B2 3/2008 Allen et al.
7,352,138 B2 4/2008 Lys et al.
7,358,679 B2 4/2008 Lys et al.
7,385,359 B2 6/2008 Dowling et al.
7,408,308 B2 8/2008 Sawada et al.
D576,964 S 9/2008 Shaner
7,427,838 B2 9/2008 Hosoya
7,432,668 B2 10/2008 Zwanenburg et al.
7,439,945 B1 10/2008 Awalt et al.
7,458,706 B1 12/2008 Liu et al.
7,513,639 B2 4/2009 Wang
7,515,128 B2 4/2009 Dowling
7,535,180 B2 5/2009 Negley et al.
7,550,934 B1 6/2009 Deng et al.
7,566,154 B2 7/2009 Gloisten et al.
7,576,496 B2 8/2009 Duggal et al.
7,614,767 B2 11/2009 Zulim et al.
7,614,769 B2 11/2009 Sell
7,637,635 B2 12/2009 Xiao et al.
7,649,326 B2 1/2010 Johnson et al.
D610,291 S 2/2010 Yoshinobu et al.
7,656,371 B2 2/2010 Shimizu et al.
7,679,292 B2 3/2010 Allen et al.
D618,376 S 6/2010 Redfern et al.
7,772,757 B2 8/2010 Kane et al.
7,780,318 B2 8/2010 Xiao et al.
7,804,256 B2 9/2010 Melanson
D625,038 S 10/2010 Yoo
7,812,553 B2 10/2010 Kang et al.
7,821,023 B2 10/2010 Yuan et al.
7,821,194 B2 10/2010 Negley et al.
D627,502 S 11/2010 Zheng et al.
D627,911 S 11/2010 Mo et al.
7,862,214 B2 1/2011 Trott et al.
7,871,184 B2 1/2011 Peng
D633,099 S 2/2011 Van de Ven
7,914,902 B2 3/2011 Kao et al.

(56) References Cited

U.S. PATENT DOCUMENTS

D636,921 S 4/2011 Van de Ven
D636,922 S 4/2011 Yoshida et al.
D638,160 S 5/2011 Van de Ven et al.
7,967,652 B2 6/2011 Emerson
7,994,725 B2 8/2011 Bouchard
8,008,845 B2 8/2011 Van de Ven
D646,011 S 9/2011 Rashida
8,148,911 B2 4/2012 Chen et al.
8,174,201 B2 5/2012 Lee
8,188,682 B2 5/2012 Nalbant
8,235,555 B2 8/2012 Thomas et al.
8,242,704 B2 8/2012 Lethellier
8,246,202 B2 8/2012 Mart et al.
8,294,388 B2 10/2012 Wong et al.
8,314,567 B2 11/2012 Ploquin et al.
8,339,029 B2 12/2012 Kim et al.
8,519,630 B2 8/2013 Wang et al.
8,525,774 B2 9/2013 Lin et al.
8,618,748 B2 12/2013 Shiu et al.
8,791,641 B2 7/2014 van de Ven et al.
2001/0032985 A1 10/2001 Bhat et al.
2002/0027453 A1 3/2002 Kulhalli et al.
2002/0043943 A1 4/2002 Menzer et al.
2002/0047624 A1 4/2002 Stam et al.
2002/0063534 A1 5/2002 Min
2002/0070914 A1 6/2002 Bruning et al.
2002/0097095 A1 7/2002 Jeon et al.
2002/0139987 A1 10/2002 Collins, III et al.
2004/0036418 A1 2/2004 Rooke et al.
2004/0042205 A1 3/2004 Tanabe et al.
2004/0208009 A1 10/2004 Mardon et al.
2004/0233145 A1 11/2004 Chiang
2004/0245946 A1 12/2004 Halter
2005/0007164 A1 1/2005 Callahan, Jr.
2005/0047134 A1 3/2005 Mueller et al.
2005/0057179 A1 3/2005 Madhani et al.
2005/0111222 A1 5/2005 Olsson et al.
2005/0122065 A1 6/2005 Young
2005/0127381 A1 6/2005 Vitta et al.
2005/0128752 A1 6/2005 Ewington et al.
2005/0140282 A1 6/2005 Park et al.
2005/0169015 A1 8/2005 Luk et al.
2005/0174065 A1 8/2005 Janning
2005/0179629 A1 8/2005 Inoue
2005/0242742 A1 11/2005 Cheang et al.
2005/0243022 A1 11/2005 Negru
2005/0254234 A1 11/2005 Wang
2005/0276053 A1 12/2005 Nortrup et al.
2005/0280376 A1 12/2005 Hamidian et al.
2006/0016960 A1 1/2006 Morgan et al.
2006/0018664 A1* 1/2006 Levinson ..... H04B 10/6911 398/135
2006/0049782 A1 3/2006 Vornsand et al.
2006/0081773 A1 4/2006 Rains et al.
2006/0097245 A1 5/2006 Aanegola et al.
2006/0153511 A1 7/2006 Franklin et al.
2006/0176411 A1 8/2006 Furukawa
2006/0221609 A1 10/2006 Ryan, Jr.
2006/0238465 A1 10/2006 Kurumisawa
2006/0244396 A1* 11/2006 Bucur ..... H05B 33/083 315/312
2006/0261754 A1 11/2006 Lee
2006/0273331 A1 12/2006 Lim et al.
2007/0013620 A1 1/2007 Tanahashi et al.
2007/0018594 A1 1/2007 Janning
2007/0040512 A1 2/2007 Jungwirth et al.
2007/0051883 A1 3/2007 Rains et al.
2007/0096661 A1 5/2007 Allen
2007/0108843 A1 5/2007 Preston et al.
2007/0115228 A1 5/2007 Roberts et al.
2007/0115662 A1 5/2007 Roberts et al.
2007/0137074 A1 6/2007 Van de Ven
2007/0139920 A1 6/2007 Van de Ven
2007/0139923 A1 6/2007 Negley
2007/0170447 A1 7/2007 Negley
2007/0171145 A1 7/2007 Coleman
2007/0182338 A1 8/2007 Shteynberg et al.
2007/0182346 A1 8/2007 Shteynberg et al.
2007/0182347 A1 8/2007 Shteynberg et al.
2007/0195023 A1 8/2007 Kang et al.
2007/0215027 A1 9/2007 MacDonald et al.
2007/0235751 A1 10/2007 Radkov et al.
2007/0236911 A1 10/2007 Negley
2007/0236920 A1 10/2007 Snyder
2007/0247414 A1 10/2007 Roberts
2007/0257623 A1 11/2007 Johnson et al.
2007/0257999 A1 11/2007 Chou
2007/0262724 A1 11/2007 Mednik et al.
2007/0263393 A1 11/2007 Van de Ven
2007/0267978 A1 11/2007 Shteynberg et al.
2007/0267983 A1 11/2007 van de Ven et al.
2007/0274063 A1 11/2007 Negley
2007/0274080 A1 11/2007 Negley
2007/0278503 A1 12/2007 Van de Ven
2007/0278934 A1 12/2007 Van de Ven
2007/0278974 A1 12/2007 Van de Ven
2007/0279440 A1 12/2007 Negley
2007/0279903 A1 12/2007 Negley
2007/0280624 A1 12/2007 Negley
2007/0285031 A1 12/2007 Shteynberg et al.
2008/0018261 A1 1/2008 Kastner
2008/0024071 A1 1/2008 Yu
2008/0030993 A1 2/2008 Narendran et al.
2008/0036364 A1 2/2008 Li et al.
2008/0043464 A1 2/2008 Ashdown
2008/0054281 A1 3/2008 Narendran et al.
2008/0062070 A1 3/2008 De Oto et al.
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0089071 A1 4/2008 Wang
2008/0094000 A1 4/2008 Yamamoto et al.
2008/0094829 A1 4/2008 Narendran et al.
2008/0105887 A1 5/2008 Narendran et al.
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0116818 A1 5/2008 Shteynberg et al.
2008/0117500 A1 5/2008 Narendran et al.
2008/0122376 A1 5/2008 Lys
2008/0128718 A1 6/2008 Sumitani
2008/0129220 A1 6/2008 Shteynberg et al.
2008/0130283 A1 6/2008 Chang
2008/0130285 A1 6/2008 Negley
2008/0136313 A1 6/2008 Van de Ven
2008/0137347 A1 6/2008 Trott
2008/0150439 A1 6/2008 Bucur
2008/0150440 A1 6/2008 Hsu
2008/0157688 A1 7/2008 Gibboney
2008/0164828 A1 7/2008 Szczeszynski et al.
2008/0179602 A1 7/2008 Negley et al.
2008/0186704 A1 8/2008 Chou et al.
2008/0203946 A1 8/2008 Ito et al.
2008/0211415 A1* 9/2008 Altamura ..... H05B 37/036 315/192
2008/0215279 A1 9/2008 Salsbury et al.
2008/0252197 A1 10/2008 Li et al.
2008/0258628 A1 10/2008 Higley et al.
2008/0259589 A1 10/2008 Van de Ven
2008/0278928 A1 11/2008 Van de Ven
2008/0278940 A1 11/2008 Van de Ven
2008/0278950 A1 11/2008 Pickard
2008/0278952 A1 11/2008 Trott
2008/0278957 A1 11/2008 Pickard
2008/0304260 A1 12/2008 Van de Ven
2008/0304261 A1 12/2008 Van de Ven
2008/0304269 A1 12/2008 Pickard
2008/0309255 A1 12/2008 Myers et al.
2009/0015759 A1 1/2009 Honbo
2009/0034283 A1 2/2009 Albright et al.

(56) References Cited

U.S. PATENT DOCUMENTS

| | | | |
|---|---|---|---|
| 2009/0039791 | A1 | 2/2009 | Jones |
| 2009/0046464 | A1 | 2/2009 | Liu et al. |
| 2009/0059582 | A1 | 3/2009 | Kulkarni |
| 2009/0079355 | A1 | 3/2009 | Zhou et al. |
| 2009/0079357 | A1 | 3/2009 | Shteynberg et al. |
| 2009/0079358 | A1 | 3/2009 | Shteynberg et al. |
| 2009/0079359 | A1 | 3/2009 | Shteynberg et al. |
| 2009/0079360 | A1 | 3/2009 | Shteynberg et al. |
| 2009/0079362 | A1 | 3/2009 | Shteynberg et al. |
| 2009/0086474 | A1 | 4/2009 | Chou |
| 2009/0095966 | A1 | 4/2009 | Keller et al. |
| 2009/0101930 | A1 | 4/2009 | Li |
| 2009/0108269 | A1 | 4/2009 | Negley |
| 2009/0140630 | A1 | 6/2009 | Kijima et al. |
| 2009/0147517 | A1 | 6/2009 | Li et al. |
| 2009/0160363 | A1 | 6/2009 | Negley et al. |
| 2009/0161356 | A1 | 6/2009 | Negley |
| 2009/0184616 | A1 | 7/2009 | Van de Ven et al. |
| 2009/0184662 | A1 | 7/2009 | Given et al. |
| 2009/0184666 | A1 | 7/2009 | Myers |
| 2009/0189529 | A1 | 7/2009 | Negley et al. |
| 2009/0195168 | A1 | 8/2009 | Greenfeld |
| 2009/0251934 | A1 | 10/2009 | Shteynberg et al. |
| 2009/0296384 | A1 | 12/2009 | Van de Ven et al. |
| 2010/0002440 | A1 | 1/2010 | Negley et al. |
| 2010/0026187 | A1 | 2/2010 | Kelly et al. |
| 2010/0026208 | A1 | 2/2010 | Shteynberg et al. |
| 2010/0045187 | A1 | 2/2010 | Shteynberg et al. |
| 2010/0045210 | A1 | 2/2010 | Hariharan |
| 2010/0060130 | A1 | 3/2010 | Li |
| 2010/0060175 | A1 | 3/2010 | Lethellier |
| 2010/0060181 | A1 | 3/2010 | Choi et al. |
| 2010/0067227 | A1 | 3/2010 | Budike |
| 2010/0072902 | A1 | 3/2010 | Wendt et al. |
| 2010/0079059 | A1 | 4/2010 | Roberts et al. |
| 2010/0079076 | A1 | 4/2010 | Chang et al. |
| 2010/0079262 | A1 | 4/2010 | Van Laanen |
| 2010/0090604 | A1 | 4/2010 | Maruyama et al. |
| 2010/0102119 | A1 | 4/2010 | Gustin et al. |
| 2010/0102199 | A1 | 4/2010 | Negley et al. |
| 2010/0102697 | A1 | 4/2010 | Van de Ven |
| 2010/0103660 | A1 | 4/2010 | Van de Ven et al. |
| 2010/0103678 | A1 | 4/2010 | Van de Ven |
| 2010/0109537 | A1 | 5/2010 | Nishino et al. |
| 2010/0109560 | A1 | 5/2010 | Yu et al. |
| 2010/0109564 | A1 | 5/2010 | Shin et al. |
| 2010/0109570 | A1 | 5/2010 | Weaver |
| 2010/0123403 | A1 | 5/2010 | Reed |
| 2010/0127282 | A1 | 5/2010 | Harbers et al. |
| 2010/0127283 | A1 | 5/2010 | Van de Ven et al. |
| 2010/0134018 | A1 | 6/2010 | Tziony et al. |
| 2010/0135016 | A1 | 6/2010 | Ishibashi |
| 2010/0141159 | A1 | 6/2010 | Shiu et al. |
| 2010/0177509 | A1 | 7/2010 | Pickard |
| 2010/0194274 | A1 | 8/2010 | Hoogzaad |
| 2010/0213859 | A1 | 8/2010 | Shteynberg et al. |
| 2010/0225220 | A1 | 9/2010 | Tanaka et al. |
| 2010/0225251 | A1 | 9/2010 | Maruyama |
| 2010/0231135 | A1 | 9/2010 | Hum et al. |
| 2010/0246177 | A1 | 9/2010 | Van de Ven |
| 2010/0246197 | A1 | 9/2010 | Takahashi et al. |
| 2010/0259182 | A1 | 10/2010 | Man et al. |
| 2010/0277084 | A1 | 11/2010 | Lee et al. |
| 2010/0308738 | A1 | 12/2010 | Shteynberg et al. |
| 2010/0308739 | A1* | 12/2010 | Shteynberg ..... H05B 33/083 315/193 |
| 2010/0315016 | A1 | 12/2010 | Hoogzaad |
| 2010/0327746 | A1 | 12/2010 | Hisayasu |
| 2011/0025217 | A1 | 2/2011 | Zhan et al. |
| 2011/0031894 | A1 | 2/2011 | Van de Ven |
| 2011/0037413 | A1 | 2/2011 | Negley et al. |
| 2011/0068696 | A1 | 3/2011 | van de Ven et al. |
| 2011/0068701 | A1 | 3/2011 | van de Ven et al. |
| 2011/0068702 | A1 | 3/2011 | van de Ven et al. |
| 2011/0074265 | A1 | 3/2011 | Van de Ven |
| 2011/0074289 | A1 | 3/2011 | Van de Ven |
| 2011/0075411 | A1 | 3/2011 | Van de Ven et al. |
| 2011/0075414 | A1 | 3/2011 | Van de Ven et al. |
| 2011/0075422 | A1 | 3/2011 | Van de Ven et al. |
| 2011/0075423 | A1 | 3/2011 | Van de Ven |
| 2011/0084614 | A1 | 4/2011 | Eisele et al. |
| 2011/0109228 | A1 | 5/2011 | Shimomura et al. |
| 2011/0115394 | A1 | 5/2011 | Shteynberg et al. |
| 2011/0115411 | A1 | 5/2011 | Shteynberg et al. |
| 2011/0121754 | A1 | 5/2011 | Shteynberg et al. |
| 2011/0148314 | A1 | 6/2011 | Lin et al. |
| 2011/0169417 | A1 | 7/2011 | Hum et al. |
| 2011/0180818 | A1 | 7/2011 | Lerman et al. |
| 2011/0181194 | A1 | 7/2011 | Hum et al. |
| 2011/0198984 | A1 | 8/2011 | Van de Ven |
| 2011/0211351 | A1 | 9/2011 | Van de Ven |
| 2011/0227484 | A1 | 9/2011 | Huynh |
| 2011/0227485 | A1 | 9/2011 | Huynh |
| 2011/0227489 | A1 | 9/2011 | Huynh |
| 2011/0227490 | A1 | 9/2011 | Huynh |
| 2011/0273102 | A1 | 11/2011 | van de Ven et al. |
| 2011/0309760 | A1 | 12/2011 | Beland et al. |
| 2012/0176826 | A1 | 7/2012 | Lazar |
| 2012/0194073 | A1 | 8/2012 | Wang et al. |
| 2012/0313545 | A1 | 12/2012 | Courtel |
| 2013/0002167 | A1 | 1/2013 | van de Ven et al. |
| 2013/0278157 | A1 | 10/2013 | Radermacher |

FOREIGN PATENT DOCUMENTS

| | | | |
|---|---|---|---|
| CN | 101137261 | A | 3/2008 |
| CN | 101292574 | A | 10/2008 |
| CN | 101379889 | A | 3/2009 |
| CN | 101657876 | A | 2/2010 |
| CN | 101668373 | A | 3/2010 |
| CN | 101772245 | A | 7/2010 |
| CN | 101821544 | | 9/2010 |
| CN | 101827481 | A | 9/2010 |
| CN | 101889475 | | 11/2010 |
| CN | 102036442 | A | 4/2011 |
| EP | 1 020 935 | A2 | 7/2000 |
| EP | 1594348 | A2 | 11/2005 |
| EP | 1 881 259 | A1 | 1/2008 |
| JP | 59-113768 | A | 6/1984 |
| JP | 4 196359 | A | 7/1992 |
| JP | H06224720 | | 8/1994 |
| JP | 3412702 | | 6/2003 |
| JP | 2003-273404 | A | 9/2003 |
| JP | 2005-310997 | A | 11/2005 |
| JP | 2006-103404 | A | 4/2006 |
| JP | 2006-332022 | A | 12/2006 |
| JP | 2007-059260 | | 3/2007 |
| JP | 2007-110075 | | 4/2007 |
| JP | 2008-059811 | | 3/2008 |
| JP | 2008059811 | | 3/2008 |
| JP | 2008-125339 | A | 5/2008 |
| JP | 2008-205357 | A | 9/2008 |
| JP | 2008-226473 | | 9/2008 |
| JP | 2008-544569 | A | 12/2008 |
| JP | 2009-016280 | A | 1/2009 |
| JP | 2009-049010 | A | 3/2009 |
| JP | 2010-008694 | | 1/2010 |
| JP | 2010-503164 | | 1/2010 |
| JP | 2010-092776 | A | 4/2010 |
| JP | 2011-508939 | A | 3/2011 |
| KR | 20100040242 | | 4/2010 |
| TW | 512575 | B | 12/2002 |
| TW | 200705714 | A | 2/2007 |
| TW | 200806081 | A | 1/2008 |
| TW | I294256 | | 3/2008 |
| WO | WO 03/096761 | | 11/2003 |
| WO | WO 2006/007388 | A1 | 1/2006 |
| WO | WO 2006/018604 | A1 | 2/2006 |
| WO | WO 2007023454 | A1 | 3/2007 |
| WO | WO 2007/090283 | A1 | 8/2007 |
| WO | WO 2008/007121 | A1 | 1/2008 |
| WO | WO 2008/036873 | | 3/2008 |
| WO | WO 2008/051957 | | 5/2008 |
| WO | WO 2008/061082 | | 5/2008 |

(56) References Cited

FOREIGN PATENT DOCUMENTS

| | | |
|---|---|---|
| WO | WO 2008/129504 A1 | 10/2008 |
| WO | WO 2009/049019 | 4/2009 |
| WO | WO 2011/037752 A2 | 3/2011 |

OTHER PUBLICATIONS

Lighting Research Center, Rensselaer Polytechnic Institute, "What is color consistency?" NLPIP, vol. 8, Issue 1, Oct. 2004. Retrieved from the internet: http://www.Lrc.rpi.edu/programs/nlpip/lightinganswers/lightsources/whatisColorConsistency.asp.
U.S. Appl. No. 13/328,144, filed Dec. 4, 2008, Chobot.
U.S. Appl. No. 13/328,115, filed Dec. 4, 2008, Chobot.
U.S. Appl. No. 11/854,744, filed Sep. 13, 2007, Myers.
U.S. Appl. No. 60/844,325, filed Sep. 13, 2006, Myers.
"*ASSIST Recommends . . . LED Life for General Lighting: Definition of Life*", vol. 1, Issue 1, Feb. 2005.
"*Bright Tomorrow Lighting Competition* (*L Prize*™)", May 28, 2008, Document No. 08NT006643.
"*Energy Star® Program Requirements for Solid State Lighting Luminaires, Eligibility Criteria—Version 1.1*", Final: Dec. 19, 2008.
Application Note: CLD-APO6.006, entitled *Cree® XLamp® XR Family & 4550 LED Reliability*, published at cree.com/xlamp, Sep. 2008.
Bulborama, Lighting Terms Reference and Glossary, http://www.bulborama.com/store/lightingreferenceglossary-13.html, 6 pages.
DuPont "*DuPont™ Diffuse Light Reflector*", Publication K-20044, May 2008, 2 pages.
EXM020, Multi-Channel 160W LED Driver, Rev. 2.0 Nov. 2010, 13 pages, www.exclara.com.
EXM055, 14.8W Dimmable LED Ballast, Rev, 0.7, Mar. 11, 2011, 10 pages, www.exclara.com.
EXM057, 14.5W Dimmable LED Ballast, Rev. 0.5, Mar. 11, 2011, 8 pages, www.exclara.com.
Furukawa Electric Co., Ltd., Data Sheet, "*New Material for Illuminated Panels Microcellular Reflective Sheet MCPET*", updated Apr. 8, 2008, 2 pages.
Global Patent Literature Text Search Corresponding to PCT Application No. PCT/US2011/38995; Date of Search: Sep. 8, 2011; 7 pages.
Illuminating Engineering Society Standard LM-80-08, entitled "*IES Approved Method for Measuring Lumen Maintenance of LED Light Sources*", Sep. 22, 2008, ISBN No. 978-0-87995-227-3.
International Preliminary Report on Patentability Corresponding to International Application No. PCT/US2010/048567; Date of Mailing: Apr. 5, 2012; 10 pages.
International Preliminary Report on Patentability corresponding to International Application No. PCT/US2010/029897; Date of Mailing: Apr. 27, 2011; 14 pages.
International Search Report and the Written Opinion of the International Searching Authority Corresponding to International Application No. PCT/US2011/038995; Date of Mailing: Sep. 16, 2011; 9 pages.
International Search Report and the Written Opinion of the International Searching Authority Corresponding to International Application No. PCT/US2011/033736; Date of Mailing: Jul. 7, 2011; 10 pages.
International Search Report and Written Opinion, PCT/US2010/048567, Oct. 29, 2010.
International Search Report Corresponding to International Application No. PCT/US2010/049581; Date of Mailing: Nov. 23, 2010; 3 pages.
International Search Report Corresponding to International Application No. PCT/US11/54846; Date of Mailing: Jan. 23, 2012; 13 pages.
International Search Report Corresponding to International Application No. PCT/US2010/048567; Dated: Oct. 29, 2010.
Kim et al. "Strongly Enhanced Phosphor Efficiency in GaInN White Light-Emitting Diodes Using Remote Phosphor Configuration and Diffuse Reflector Cup" *Japanese Journal of Applied Physics* 44(21):L649-L651 (2005).
LEDs Magazine, Press Release May 23, 2007, "*Furukawa America Debuts MCPET Reflective Sheets to Improve Clarity, Efficiency of Lighting Fixtures*", downloaded Jun. 25, 2009 from http://www.ledsmagazine.com/press/15145, 2 pages.
MCPET—Microcellular Reflective Sheet Properties, http://www.trocellen.com, downloaded Jun. 25, 2009, 2 pages.
Notification of Transmittal of the International Search Report and the Written Opinion of the International Searching Authority, or the Declaration; International Search Report; and Written Opinion of the International Searching Authority, PCT Application No. PCT/US2010/037608, Jul. 30, 2010.
Notification of Transmittal of the International Search Report and the Written Opinion of the International Searching Authority, or the Declaration, International Search Report, and Written Opinion of the International Searching Authority, PCT International Application No. PCT/US2006/011820, Aug. 7, 2006.
Notification of transmittal of the international search report and the written opinion of the international searching authority, or declaration, PCT/US2010/029897, Jun. 23, 2010.
Notification of Transmittal of the International Search Report and the Written Opinion of the International Searching Authority, or the Declaration; International Search Report; Written Opinion of the International Searching Authority; Corresponding to International Application No. PCT/US2010/048225; Dated: Nov. 4, 2010; 11 pages.
Philips Lumileds, Technology White Paper: "Understanding power LED lifetime analysis", downloaded from http://www.philipslumileds.com/pdfs/WP12.pdf, Document No. WP12, Last Modified May 22, 2007.
Sutardja, P., "Design for High Quality and Low Cost SSL with Power Factor Correction", Marvell Semiconductor Inc. Jul. 2011. 16 pages.
International Preliminary Report on Patentability Corresponding to International Application No. PCT/US2011/033736; Date of Mailing: Nov. 22, 2012; 8 Pages.
International Search Report Corresponding to International Application No. PCT/US12/47643; Date of Mailing: Oct. 25, 2012; 10 Pages.
International Search Report Corresponding to International Application No. PCT/US12/54888; Date of Mailing: Nov. 23, 2012; 12 Pages.
International Search Report Corresponding to International Application No. PCT/US12/54869; Date of Mailing: Nov. 23, 2012; 10 Pages.
International Search Report Corresponding to International Application No. PCT/US12/69079; Date of Mailing: Feb. 28, 2013; 20 Pages.
International Preliminary Report on Patentability Corresponding to International Application No. PCT/US2011/038995; Date of Mailing: Dec. 20, 2012; 7 Pages.
International Preliminary Report on Patentability Corresponding to International Application No. PCT/US2011/054846; Date of Mailing: May 16, 2013; 10 Pages.
Office Action, JP 2012-530920, Jun. 12, 2013.
Japanese Office Action Corresponding to Japanese Patent Application No. 2013-509109; Mailing Date: Sep. 17, 2013; Foreign Text, 2 Pages, English Translation Thereof, 3 Pages.
International Preliminary Report on Patentability Corresponding to International Application No. PCT/US2012/040189; Date of Mailing: Dec. 19, 2013, 13 Pages.
Japanese Office Action Corresponding to Japanese Patent Application No. 2012-530920; Mailing Date: May 28, 2014; Foreign Text, 3 Pages; English Translation Thereof, 2 Pages.
International Preliminary Report on Patentability Corresponding to International Application No. PCT/US2012/054869; Date of Mailing: Mar. 27, 2014; 8 Pages.
International Preliminary Report on Patentability Corresponding to International Application No. PCT/US2012/054888; Date of Mailing: Mar. 27, 2014; 10 Pages.

(56) References Cited

OTHER PUBLICATIONS

European Search Report Corresponding to European Application No. 10849249.3; Dated: Mar. 27, 2014; 8 Pages.
European Search Report Corresponding to European Application No. 11838419.7; Dated: Feb. 17, 2014; 7 Pages.
European Search Report Corresponding to European Application No. 11777867.0; Dated: May 13, 2014; 7 Pages.
Chinese Office Action Corresponding to Chinese Application No. 201180022813.5; Date of Issue: Feb. 25, 2014; Foreign Text: 16 Pages, English Translation: 5 Pages.
Chinese Office Action Corresponding to Chinese Patent Application No. 201080053242.7; Date of Issue: Nov. 27, 2013; 35 Pages.
Chinese First Office Action Corresponding to Chinese Application No. 201180004266.8; Date of Issue: Nov. 3, 2014; 4 Pages.
Chinese Office Action and Search Report Corresponding to Chinese Patent Application No. 201280044038.8; Date of Notification: Dec. 12, 2014; Foreign Text, 16 Pages, English Translation Thereof, 7 Pages.
Chinese First Office Action and Search Report Corresponding to Chinese Patent Application No. 201180063337.1; Date of Issue: Dec. 3, 2014; Foreign Text, 7 Pages, English Translation Thereof, 14 Pages.
Chinese Second Office Action Corresponding to Chinese Patent Application No. 201080053889.X; Date of Issue: Dec. 17, 2014; 15 Pages.
Chinese First Office Action Corresponding to Chinese Application No. 201280034828.8; Date of Issue: Jan. 5, 2015; 10 Pages.
Hardware Zone News "Agilent Technologies introduces breakthrough flat-panel TV illumination system that delivers 25 percent more brilliant colors", Jan. 7, 2005.
Chinese Office Action Corresponding to Chinese Patent Application No. 201280067925.7; Date Mailed: Jun. 30, 2015; Foreign Text, 11 Pages, English Translation Thereof, 7 Pages.
Taiwanese Office Action Corresponding to Taiwanese Patent Application No. 099131743; Date Mailed: May 20, 2015; Foreign Text, 12 Pages, English Translation Thereof, 7 Pages.
European Search Report Corresponding to European Patent Application No. 12 85 7650; Dated: Oct. 13, 2015; 7 Pages.
European Search Report Corresponding to European Patent Application No. 12 85 8366; Dated: Oct. 13, 2015; 8 Pages.
European Search Report, EP Application No. 12832595; mailed Sep. 30, 2015, 6 pages.
European Search Report Corresponding to Patent Application No. 12 79 2795; Dated: Nov. 11, 2015; 7 Pages.
Japanese Final Rejection Corresponding to Patent Application No. 2014-513696; Dispatched Date: Oct. 14, 2015; Foreign Text, 2 Pages, English Translation Thereof, 2 Pages.
Korean Notice of Preliminary Rejection Corresponding to Patent Application No. 10-2012-7029011; Issuance Date: Nov. 19, 2015; Foreign Text, 7 Pages, English Translation Thereof, 5 Pages.
Taiwanese Office Action Corresponding to Application No. 101131404; Dated: Nov. 19, 2015; Foreign Text Only, 15 pages.
Preliminary Rejection, corresponding KR Patent Application No. 10-2012-7029011, mailed May 10, 2016 (11 pages including translation).
Chinese Third Office Action Corresponding to Application No. 201280067925.7: Date of Notification: Sep. 28, 2016; Foreign Text, 15 Pages, English Translation Thereof, 9 Pages.

* cited by examiner

SOLID STATE LIGHTING APPARATUS WITH CONTROLLABLE BYPASS CIRCUITS AND METHODS OF OPERATION THEREOF

CROSS-REFERENCE TO RELATED APPLICATIONS

The present application is related to U.S. patent application Ser. No. 12/566,142, filed Sep. 24, 2009, entitled "Solid State Lighting Apparatus With Configurable Shunts," the disclosures of which are hereby incorporated herein by reference and concurrently filed herewith.

FIELD

The present inventive subject matter relates to lighting apparatus and, more particularly, to solid state lighting apparatus.

BACKGROUND

Solid state lighting devices are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

The color rendering index (CRI) of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

It is often desirable to provide a lighting source that generates a white light having a high color rendering index, so that objects and/or display screens illuminated by the lighting panel may appear more natural. Accordingly, to improve CRI, red light may be added to the white light, for example, by adding red emitting phosphor and/or red emitting devices to the apparatus. Other lighting sources may include red, green and blue light emitting devices. When red, green and blue light emitting devices are energized simultaneously, the resulting combined light may appear white, or nearly white, depending on the relative intensities of the red, green and blue sources.

SUMMARY

A lighting apparatus according to some embodiments of the present inventive subject matter includes a string with a plurality of serially-connected light emitting device sets, each set comprising at least one light emitting device. The apparatus further includes at least one controllable bypass circuit configured to variably bypass current around at least one light emitting device of a set of the plurality of light emitting device sets responsive to a control input. The control input may include, for example, a temperature input, a string current sense input, a light input and/or an adjustment input.

In some embodiments, the plurality of light emitting device sets includes a plurality of color point sets. The plurality of color point sets may include, for example, a set of nominally blue-shifted yellow (BSY) light emitting diodes (LEDs) and a set of nominally red LEDs, and the controllable bypass circuit may be configured to variably bypass current around at least one LED of the set of nominally BSY LEDs.

In further embodiments of the present inventive subject matter, the at least one controllable bypass circuit comprises a plurality of controllable bypass circuits, respective ones of which are configured to variably bypass respective currents around at least one light emitting device of respective ones of the plurality of light emitting device sets. In some embodiments, the at least one controllable bypass circuit may include a plurality of controllable bypass circuit connected in parallel with the at least one light emitting device and configured to variably bypass current around the at least one light emitting device responsive to respective control inputs.

According to some embodiments, the controllable bypass circuit may include a variable resistance circuit, such as a transistor biased by a voltage divider. In further embodiments, the controllable bypass circuit may include a switch configured to couple and decouple circuit nodes connected to the at least one light emitting device and a PWM controller circuit configured to operate the switch responsive to the control input.

According to further aspects of the present invention, the at least one controllable bypass circuit may be configured to be powered via at least one node of the string. For example, the at least one controllable bypass circuit may be configured to be powered by a forward voltage across at least one light-emitting device in the string.

In additional embodiments, the at least one controllable bypass circuit may include a communications circuit configured to receive the control input via the string.

Further embodiments of the present inventive subject matter provide a lighting apparatus including a string comprising at least one LED and at least one controllable bypass circuit configured to variably bypass current around at the at least one LED via at least one ancillary diode having a different forward voltage characteristic than the at least one LED responsive to a control input. The control input may include, for example, a temperature input, a string current sense input and/or an adjustment input. The at least one ancillary diode may include, for example, at least one ancillary LED, such as an ancillary LED having a different color point than the at least one LED. In other embodiments, the at least one ancillary diode may be configured to emit non-visible electromagnetic radiation.

In some embodiments, the at least one controllable bypass circuit comprises a switch connected in series with the ancillary diode and configured to couple and decouple circuit nodes connected to the at least one LED and a PWM controller circuit configured to operate the switch responsive to the control input. In further embodiments, the at least one controllable bypass circuit may include a variable resistance circuit.

According to further aspects, the at least one controllable bypass circuit may be configured to be powered via at least one node of the string. The at least one controllable bypass circuit may be configured to be powered by a forward voltage across the at least one ancillary diode.

In some embodiments, the at least one controllable bypass circuit may include a plurality of controllable bypass circuits, respective ones of which are configured to variably bypass respective currents around respective at least one LEDs. In further embodiments, the at least one controllable bypass circuit may include a plurality of controllable bypass circuit connected in parallel with the at least one LED and configured to variably bypass current around the at least one LED responsive to respective control inputs.

Further embodiments of the present invention provide methods of adjusting a lighting apparatus including a string having a plurality of serially-connected light emitting device sets, each set including at least one light emitting device. The methods include bypassing current around at least one light emitting device of a set of the plurality of light emitting device sets responsive to a control input. The control input may be varied, for example, to adjust a color point of the string.

The plurality of light emitting device sets may include, for example, a plurality of color point sets, such as a set of nominally blue-shifted yellow (BSY) light emitting diodes (LEDs) and a set of nominally red LEDs. Bypassing current around at least one light emitting device of a set of the plurality of light emitting device sets responsive to a control input may include bypassing current around at least one LED of the set of nominally BSY LEDs.

Bypassing current around at least one light emitting device of a set of the plurality of light emitting device sets responsive to a control input may include bypassing respective currents around at least one light emitting device of respective ones of the plurality of light emitting device sets. Bypassing current around at least one light emitting device of a set of the plurality of light emitting device sets responsive to a control input may include bypassing current around the at least one light emitting device via respective bypass paths responsive to respective control inputs.

Bypassing current around at least one light emitting device of a set of the plurality of light emitting device sets responsive to a control input may include controlling a switch and/or a variable resistance circuit connected in parallel with the at least one light emitting device. Controlling a switch and/or a variable resistance circuit connected in parallel with the at least one light emitting device may include controlling the switch and/or the variable resistance circuit responsive to a temperature, a string current and/or an external input.

Further embodiments of the present invention provide methods of operating a lighting apparatus including a string with at least one LED. The methods include bypassing current around at the at least one LED via at least one ancillary diode having a different forward voltage characteristic than the at least one LED responsive to a control input. The control input may include a temperature input, a string current sense input and/or an adjustment input. The control input may be varied, for example, to adjust a color point of the string. The at least one ancillary diode may include at least one ancillary LED, such as an LED having a different color point. Bypassing current around the at least one LED via at least one ancillary diode having a different forward voltage characteristic than the at least one LED responsive to a control input may include conducting current through the ancillary diode using a switch and/or a variable resistance circuit.

A lighting apparatus according to further embodiments of the present inventive subject matter includes a string comprising a plurality of serially-connected light emitting device sets, each set comprising at least one light emitting device and a fixed bypass circuit configured to bypass a fixed amount of current around at least one light emitting device of at least one selected set of the plurality of light emitting device sets over a range of levels of a total current passing through the string. The fixed bypass circuit may be configured to bypass at least one light emitting device of a first set of the plurality of light emitting device sets such that, in response to variation of the total current, a current passing through the first set varies at a different rate than a current passing through a second set of the plurality of light emitting device sets. The apparatus may further include a controllable bypass circuit configured to variably bypass current around at least one light emitting device of the second set of light emitting devices responsive to a control input.

Other apparatus and/or methods according to embodiments of the present inventive subject matter will be or become apparent to one with skill in the art upon review of the following drawings and detailed description. It is intended that all such additional apparatus and/or methods be included within this description, be within the scope of the present inventive subject matter, and be protected by the accompanying claims.

BRIEF DESCRIPTION OF THE DRAWINGS

The accompanying drawings, which are included to provide a further understanding of the present inventive subject matter and are incorporated in and constitute a part of this application, illustrate certain embodiment(s) of the present inventive subject matter.

DETAILED DESCRIPTION OF EMBODIMENTS

Figure 1A:
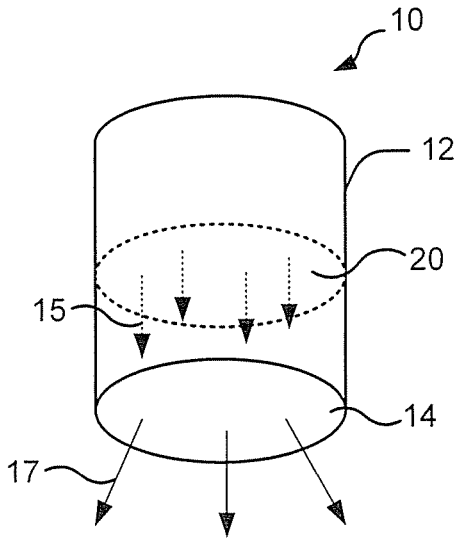
FIGS. 1A and 1B illustrate a solid state lighting apparatus in accordance with some embodiments of the present inventive subject matter.

Embodiments of the present inventive subject matter now will be described more fully hereinafter with reference to the accompanying drawings, in which embodiments of the present inventive subject matter are shown. This present inventive subject matter may, however, be embodied in many different forms and should not be construed as limited to the embodiments set forth herein. Rather, these embodiments are provided so that this disclosure will be thorough and complete, and will fully convey the scope of the present inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

Figure 1B:
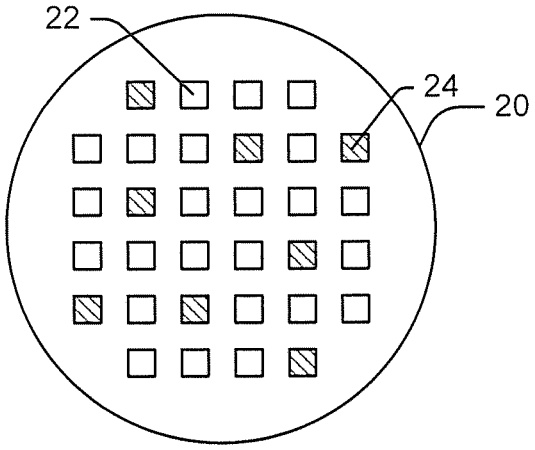

Referring to FIGS. 1A and 1B, a lighting apparatus 10 according to some embodiments is illustrated. The lighting apparatus 10 shown in FIGS. 1A and 1B is a "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 1A and 1B, the lighting panel 20 has a generally circular shape so as to fit within an interior of the cylindrical housing 12. Light is generated by solid state lighting devices (LEDs) 22, 24, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern.

Still referring to FIGS. 1A and 1B, the solid-state lighting apparatus 10 may include a plurality of first LEDs 22 and a plurality of second LEDs 24. In some embodiments, the plurality of first LEDs 22 may include white emitting, or near white emitting, light emitting devices. The plurality of second LEDs 24 may include light emitting devices that emit light having a different dominant wavelength from the first LEDs 22, so that combined light emitted by the first LEDs 22 and the second LEDs 24 may have a desired color and/or spectral content. For example, the combined light emitted by the plurality of first LEDs 22 and the plurality of second LEDs 24 may be warm white light that has a high color rendering Index.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 2500K and 8000K. White light with a CCT of 2500K has a reddish color, white light with a CCT of 4000K has a yellowish color, and while light with a CCT of 8000K is bluish in color.

"Warm white" generally refers to white light that has a CCT between about 3000 and 3500° K. In particular, warm white light may have wavelength components in the red region of the spectrum, and may appear yellowish to an observer. Incandescent lamps are typically warm white light. Therefore, a solid state lighting device that provides warm white light can cause illuminated objects to have a more natural color. For illumination applications, it is therefore desirable to provide a warm white light. As used herein, white light refers to light having a color point that is within 7 MacAdam step ellipses of the black body locus or otherwise falls within the ANSI C78-377 standard.

In order to achieve warm white emission, conventional packaged LEDs include either a single component orange phosphor in combination with a blue LED or a mixture of yellow/green and orange/red phosphors in combination with a blue LED. However, using a single component orange phosphor can result in a low CRT as a result of the absence of greenish and reddish hues. On the other hand, red phosphors are typically much less efficient than yellow phosphors. Therefore, the addition of red phosphor in yellow phosphor can reduce the efficiency of the package, which can result in poor luminous efficacy. Luminous efficacy is a measure of the proportion of the energy supplied to a lamp that is converted into light energy. It is calculated by dividing the lamp's luminous flux, measured in lumens, by the power consumption, measured in watts.

Warm white light can also be generated by combining non-white light with red light as described in U.S. Pat. No. 7,213,940, entitled "LIGHTING DEVICE AND LIGHTING METHOD," which is assigned to the assignee of the present inventive subject matter, and the disclosure of which is incorporated herein by reference. As described therein, a lighting device may include first and second groups of solid state light emitters, which emit light having dominant wavelength in ranges of from 430 nm to 480 nm and from 600 nm to 630 nm, respectively, and a first group of phosphors which emit light having dominant wavelength in the range of from 555 nm to 585 nm. A combination of light exiting the lighting device which was emitted by the first group of emitters, and light exiting the lighting device which was emitted by the first group of phosphors produces a sub-mixture of light having x, y color coordinates within a defined area on a 1931 CIE Chromaticity Diagram that is referred to herein as "blue-shifted yellow" or "BSY." Such non-white light may, when combined with light having a dominant wavelength from 600 nm to 630 nm, produce warm white light.

Blue and/or green LEDs used in a lighting apparatus according to some embodiments may be InGaN-based blue and/or green LED chips available from Cree, Inc., the assignee of the present inventive subject matter. Red LEDs used in the lighting apparatus may be, for example, AlInGaP LED chips available from Epistar, Osram and others.

In some embodiments, the LEDs 22, 24 may have a square or rectangular periphery with an edge length of about 900 μm or greater (i.e. so-called "power chips." However, in other embodiments, the LED chips 22, 24 may have an edge length of 500 μm or less (i.e. so-called "small chips"). In particular, small LED chips may operate with better electrical conversion efficiency than power chips. For example, green LED chips with a maximum edge dimension less than 500 microns and as small as 260 microns, commonly have a higher electrical conversion efficiency than 900 micron chips, and are known to typically produce 55 lumens of luminous flux per Watt of dissipated electrical power and as much as 90 lumens of luminous flux per Watt of dissipated electrical power.

The LEDs 22 in the lighting apparatus 10 may include white/BSY emitting LEDs, while the LEDs 24 in the lighting apparatus may emit red light. Alternatively or additionally, the LEDs 22 may be from one color bin of white LEDs and the LEDs 24 may be from a different color bin of white LEDs. The LEDs 22, 24 in the lighting apparatus 10 may be electrically interconnected in one or more series strings, as in embodiments of the present inventive subject matter described below. While two different types of LEDs are illustrated, other numbers of different types of LEDs may also be utilized. For example, red, green and blue (RGB) LEDs, RGB and cyan, RGB and white, or other combinations may be utilized.

To simplify driver design and improve efficiency, it is useful to implement a single current source for powering a series-connected string of LEDs. This may present a color control problem, as every emitter in the string typically receives the same amount of current. It is possible to achieve a desired color point by hand picking a combination of LEDs that comes close enough when driven with a given current. If either the current through the string or the temperature of the LEDs changes, however, the color may change as well.

Some embodiments of the present inventive subject matter arise from a realization that color point control of the combined light output of LEDs that are configured in a single string may be achieved by selectively bypassing current around certain LEDs in a string having at least two LEDs having different color points. As used herein, LEDs have different color points if they come from different color, peak wavelength and/or dominant wavelength bins. The LEDs may be LEDs, phosphor converted LEDs or combinations thereof. LEDs are configured in a single string if the current through the LEDs cannot be changed without affecting the current through other LEDs in the string. In other words, the flow of current through any given branch of the string may be controlled but the total quantity of current flowing through the string is established for the entire string. Thus, a single string of LEDs may include LEDs that are configured in series, in parallel and/or in series/parallel arrangements.

In some embodiments, color point control may be provided in a single string by selectively bypassing current around portions of the string to control current through selected portions of the string. In some embodiments, a bypass circuit pulls current away from a portion of the string to reduce the light output level of that portion of the string. The bypass circuit may also supply current to other portions of the string, thus causing some portions of the string to have current reduced and other portions of the string to have current increased. LEDs may be included in the bypass path. In some embodiments, a bypass circuit shunting circuit may switch current between two or more paths in the string. The control circuitry may be biased or powered by the voltage across the string or a portion of the string and, therefore, may provide self contained, color tuned LED devices.

Figure 2:
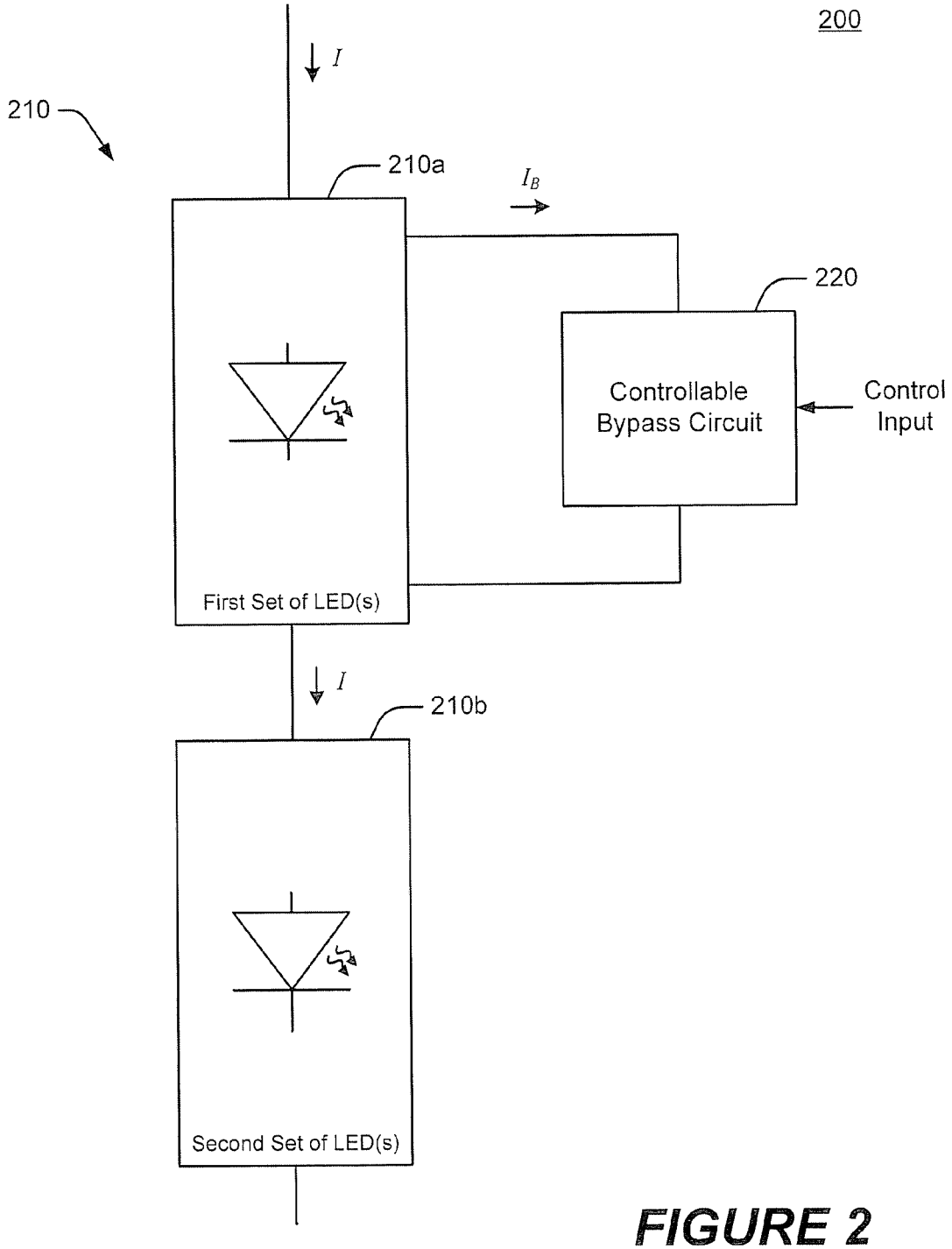
FIG. 2 illustrates a lighting apparatus with a controllable bypass circuit according to some embodiments of the present inventive subject matter.

FIG. 2 illustrates a lighting apparatus 200 according to some embodiments of the present inventive subject matter. The apparatus includes a string of series connected light-emitting devices, specifically a string 210 including first and second sets 210*a*, 210*b*, each including at least one light emitting diode (LED). In the illustrated embodiments, the apparatus includes a controllable bypass circuit 220 configured to selectively bypass a current $I_B$ around the first set 210*a* responsive to a control input, such that an amount of illumination provided by the first set 210*a* of the first type may be controlled relative to the illumination provided by the at least one LED 210*b* of the second type. The control input may include, for example, a temperature, a string current, a light input (e.g., a measurement of light output and/or ambient light) and/or a user adjustment.

The first and second sets may be defined according to a variety of different criteria. For example, in some embodiments described below, a controllable bypass circuit along the lines of the bypass circuit 220 of FIG. 1 may be used to control illumination provided by different color point sets of LEDs in a serial string. In other embodiments, LED sets may be defined according to other characteristics, such as current vs. illumination characteristics.

Figure 3:
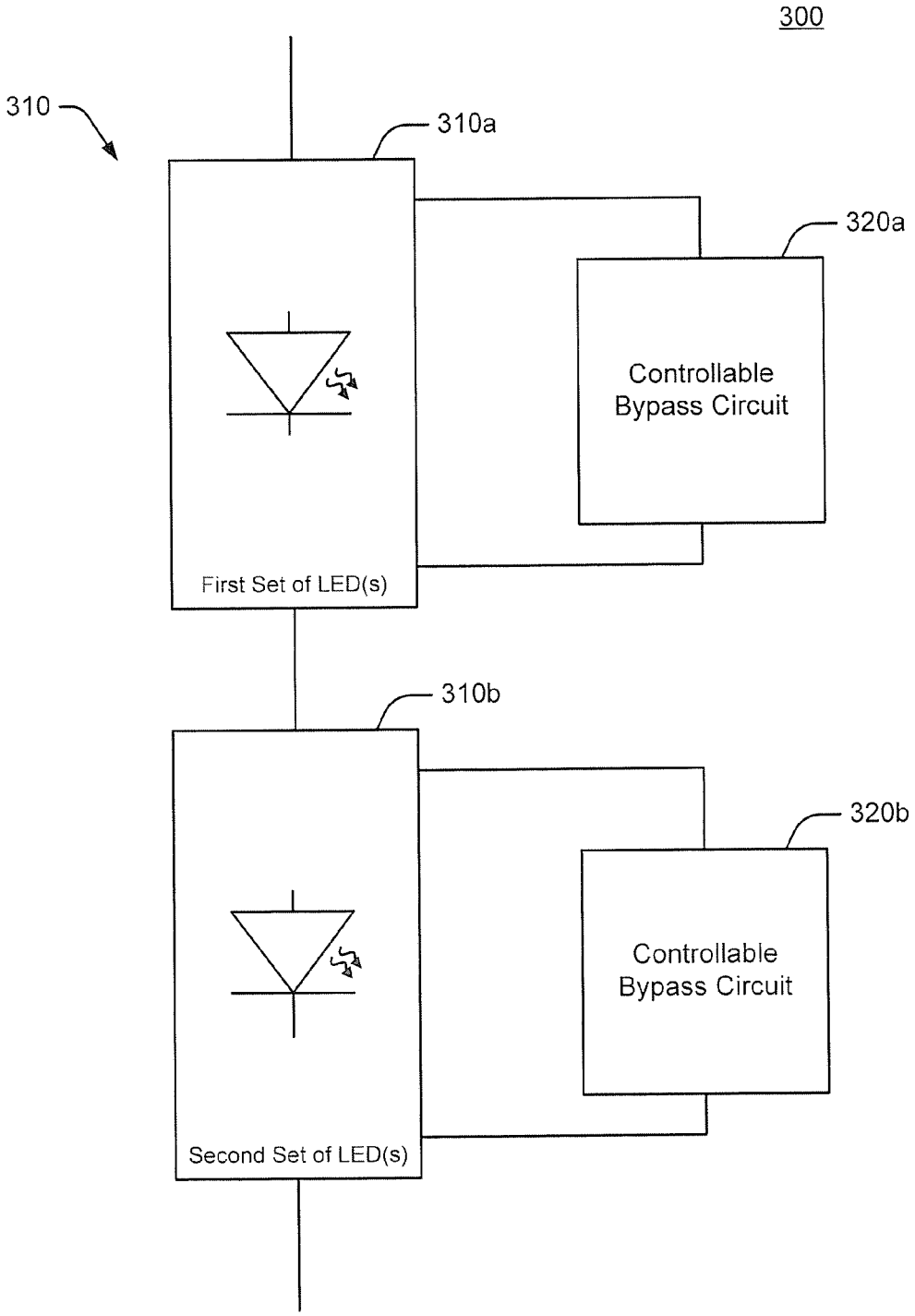
FIGS. 3 and 4 illustrate lighting apparatus with multiple controllable bypass circuits according to some embodiments of the present inventive subject matter.
Figure 4:
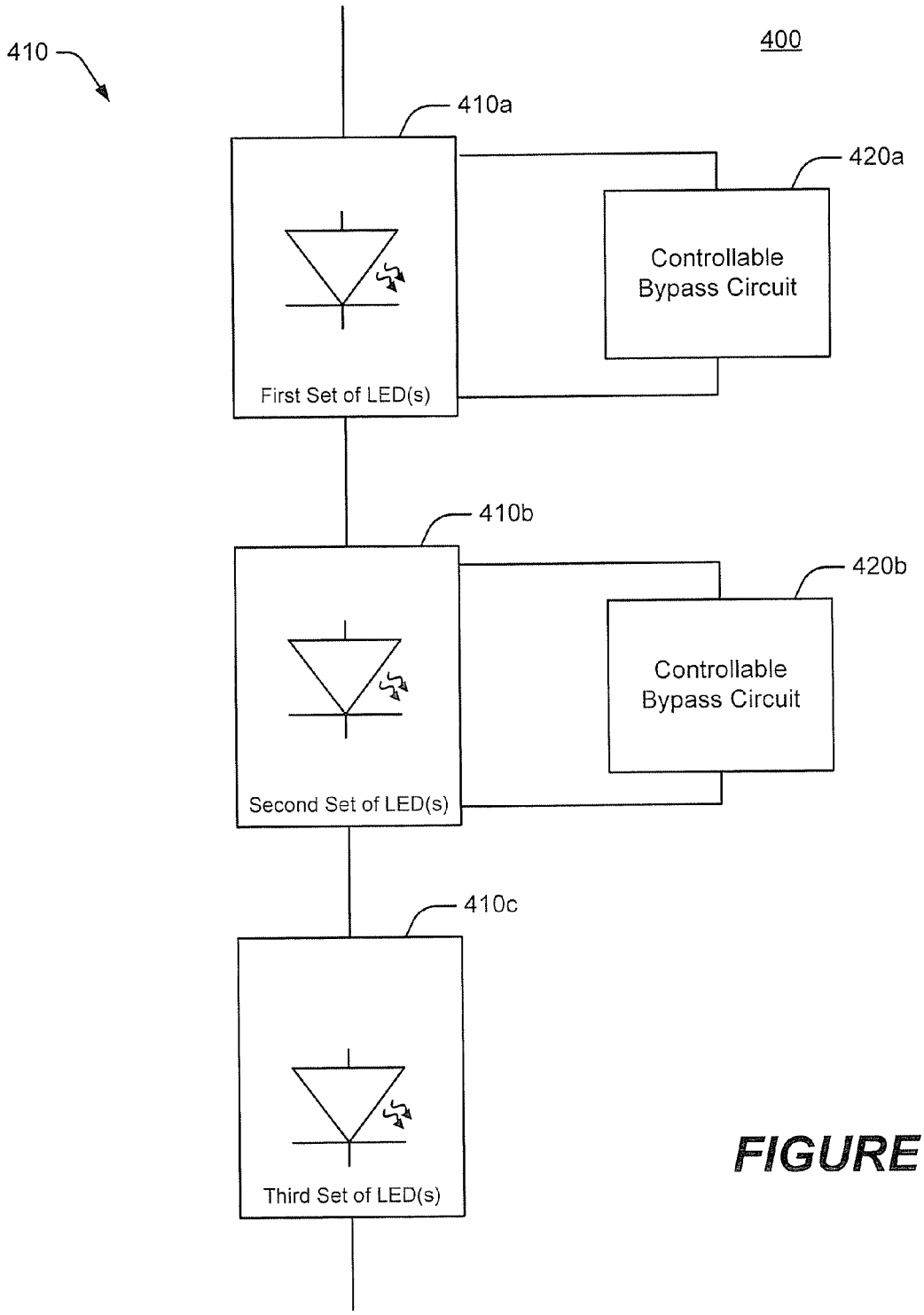

In some embodiments, multiple such controllable bypass circuits may be employed for multiple sets. For example, as illustrated in FIG. 3, a lighting apparatus 300 according to some embodiments of the present inventive subject matter may include a string 310 comprising first and second sets of LEDs 310*a*, 310*b*. Respective controllable bypass circuits 320*a*, 320*b* are provided for the respective sets of LEDs. As illustrated in FIG. 4, a lighting apparatus 400 may include a string 410 with three sets 410*a*, 410*a*, 410*c* of LEDs, wherein only the first and second sets 410*a*, 410*b* have associated controllable bypass circuits 420*a*, 420*b*.

Figure 5:
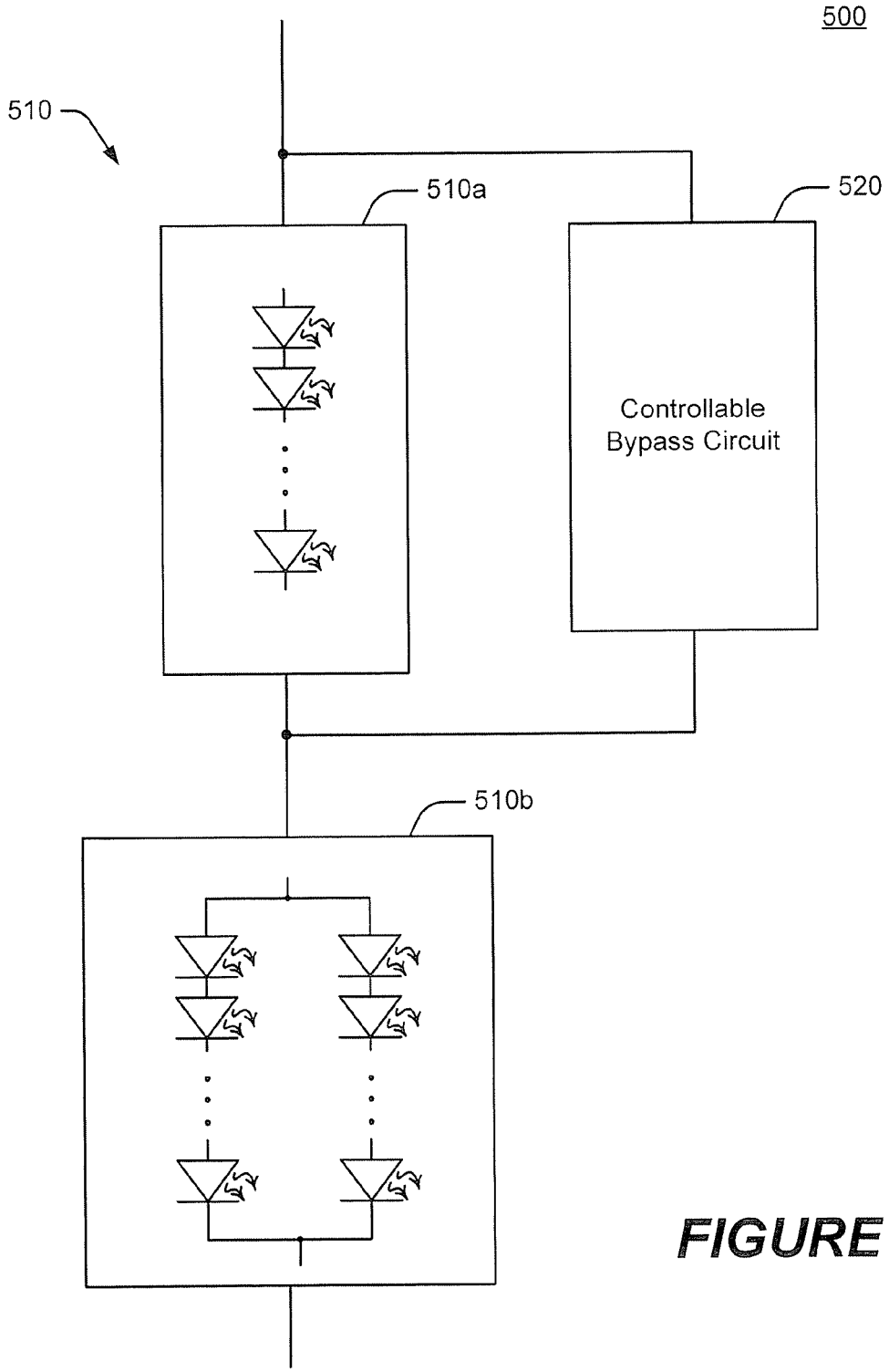
FIG. 5 illustrates a lighting apparatus with a controllable bypass circuit and multiple string configurations according to some embodiments of the present inventive subject matter.

In some embodiments, different sets within a string may have different configurations. For example, in a lighting apparatus 500 shown in FIG. 5, a first set 510*a* of a string 510 includes a single string of LEDs, with a controllable bypass circuit 520 being connected across the set 510*a* at terminal nodes thereof. A second set 510*b* of LEDs of the string, however, may comprise two or more parallel-connected substrings of LEDs.

Figure 6:
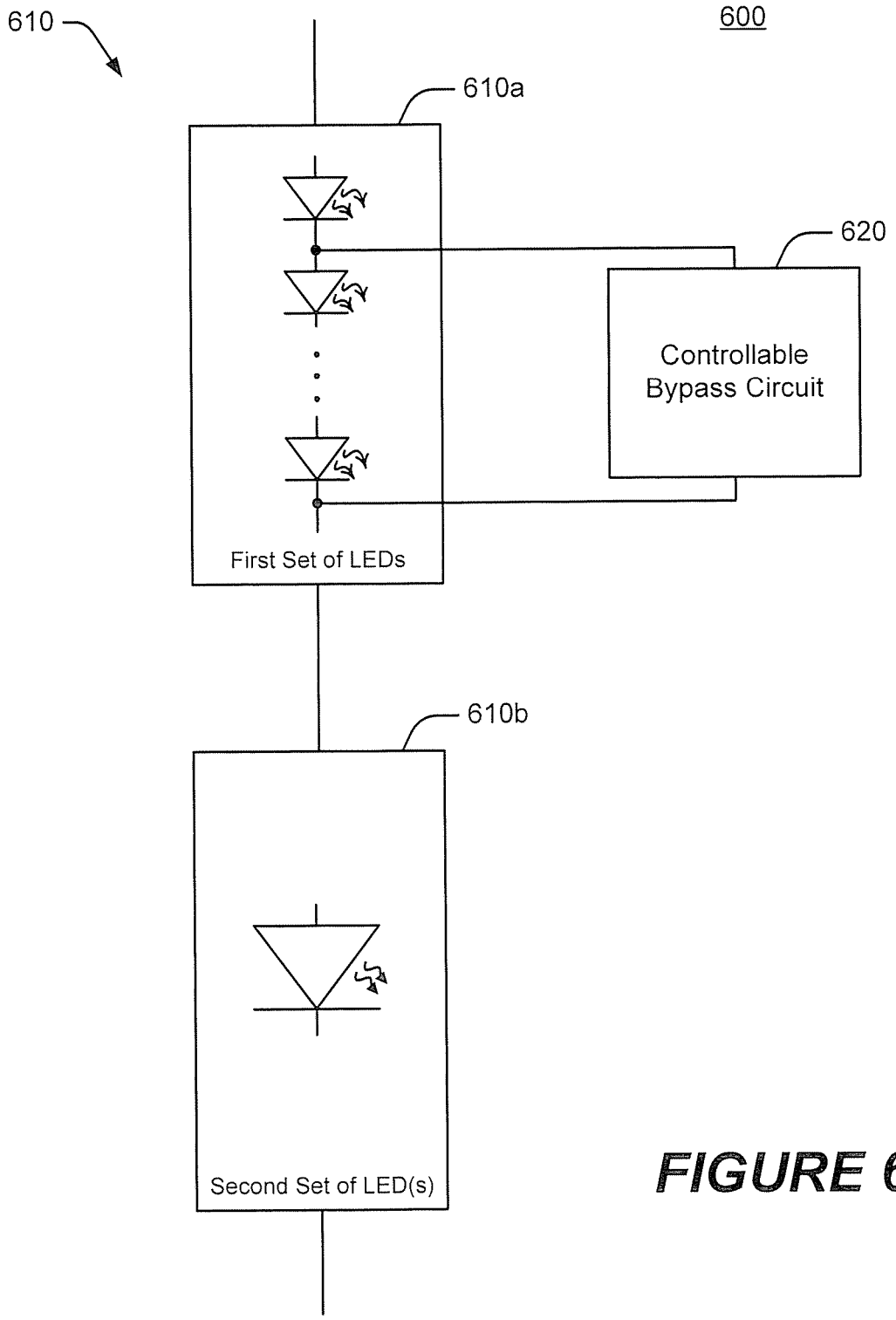
FIG. 6 illustrates interconnections of a lighting apparatus with a controllable bypass circuit according to some embodiments of the present inventive subject matter.

According to further embodiments, an entire set of LEDs may be bypassed, or individual LEDs within a given set may be bypassed. For example, in a lighting apparatus 600 shown in FIG. 6, in a string 610 including first and second sets 610*a*, 610*b*, each comprising a single string of LED's, a controllable bypass circuit 620 may be connected at an internal node in the first set 610*a*.

Figure 7:
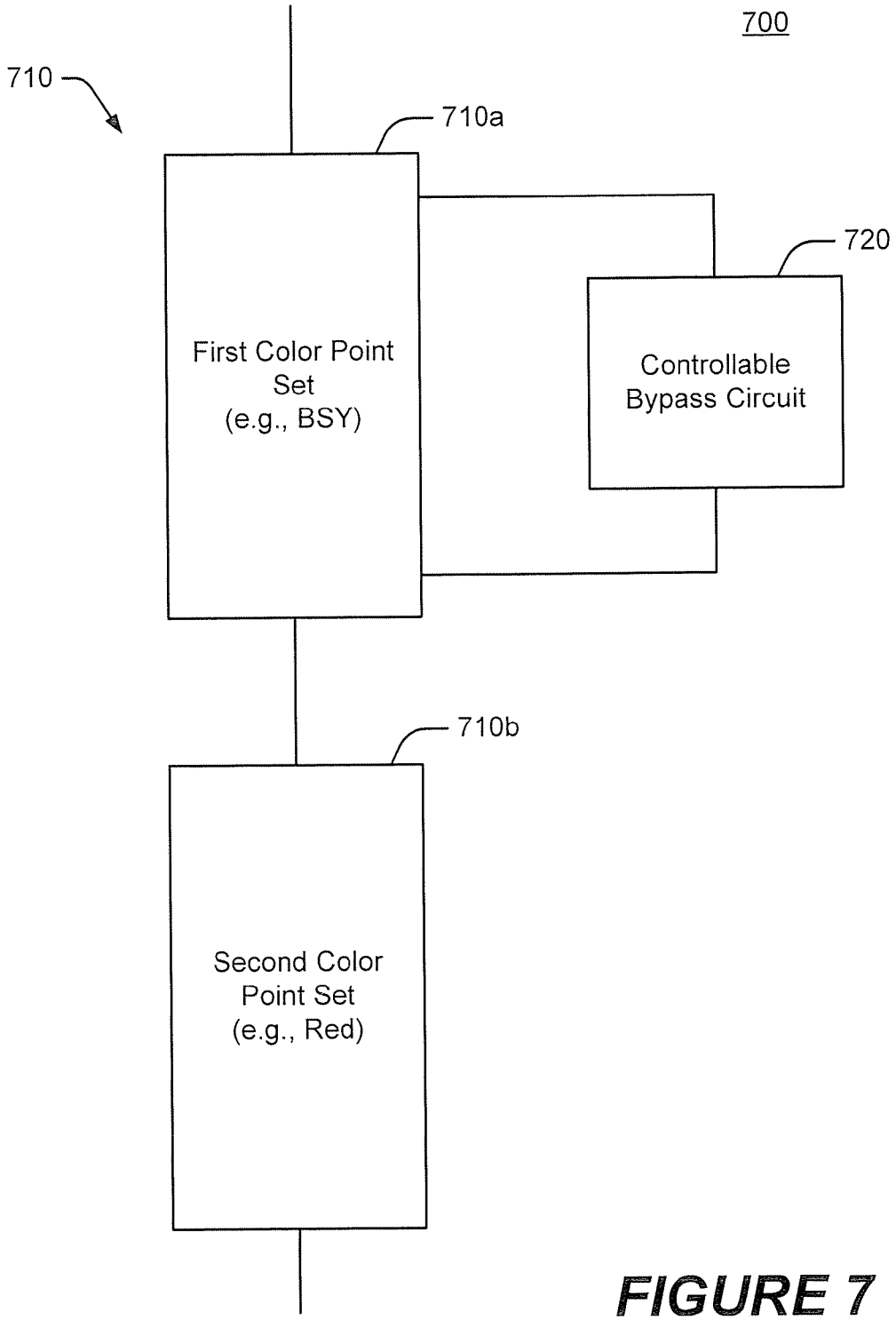
FIGS. 7 and 8 illustrate lighting apparatus with controllable bypass circuits for selected color point sets according to some embodiments of the present inventive subject matter.

As noted above, in some embodiments of the present inventive subject matter, sets of LEDs may be defined in a number of different ways. For example, as shown in FIG. 7, a lighting apparatus 700 may include a string 710 including first and second color point sets 710*a*, 710*b*. As illustrated, for example, the first color point set 710 may comprise one or more LEDs falling within a generally BSY color point set, while the second color point set 710*b* may include one or more LEDs falling within a generally red color point set. It will be appreciated the LEDs within a given one of the color point set 710*a*, 710*b* may not have identical color point characteristics, but instead may fall within a given color point range such that the group, as a whole, provides an aggregate color point that is generally BSY, red or some other color.

As further shown in FIG. 7, a controllable bypass circuit 720 is configured to controllably bypass current around the first color point set 710*a*. Adjusting the amount of current bypassed around the first color point set 710 may provide for control of the amount of illumination provided by the first color point set 710 relative to the second color point set 710*b*, such that an aggregate color point of the string 710 may be controlled.

Some embodiments of the present inventive subject matter may have a variety of configurations where a load independent current (or load-independent voltage that is converted to a current) is provided to a string of LEDs. The term "load independent current" is used herein to refer to a current source that provides a substantially constant current in the presence of variations in the load to which the current is supplied over at least some range of load variations. The current is considered constant if it does not substantially alter the operation of the LED string. A substantial alteration in the operation of the LED string may include a change in luminous output that is detectable to a user. Thus, some variation in current is considered within the scope of the term "load independent current." However, the load independent current may be a variable current responsive to user input or other control circuitry. For example, the load independent current may be varied to control the overall luminous output of the LED string to provide dimming, for lumen maintenance or to set the initial lumen output of the LED string.

In the illustrated embodiments of FIG. 7, the bypass circuit 720 is connected in parallel with the BSY color point set 710*a* of the LED string 710*a* so as to control the amount of current through the BSY color point set 710*a*. In particular, the string current I is the sum of the amount of current through the BSY portion 710*a* of the string 710 and the amount of current $I_B$ passing through the bypass circuit 720. By increasing $I_B$, the amount of current passing through the BSY color point set 710*a* is decreased. Likewise, by decreasing the current $I_B$ passing through the bypass circuit 720, the current passing through the BSY color point set 710*a* is increased. However, because the bypass circuit 720 is only parallel to the BSY color point set 710*a*, the current through the red color point set 710*b* remains the total string current I. Accordingly, the ratio of the contribution to the total light output provided by the BSY color point set 710*a* to that provided by the red color point set 710*b* may be controlled.

Figure 8:
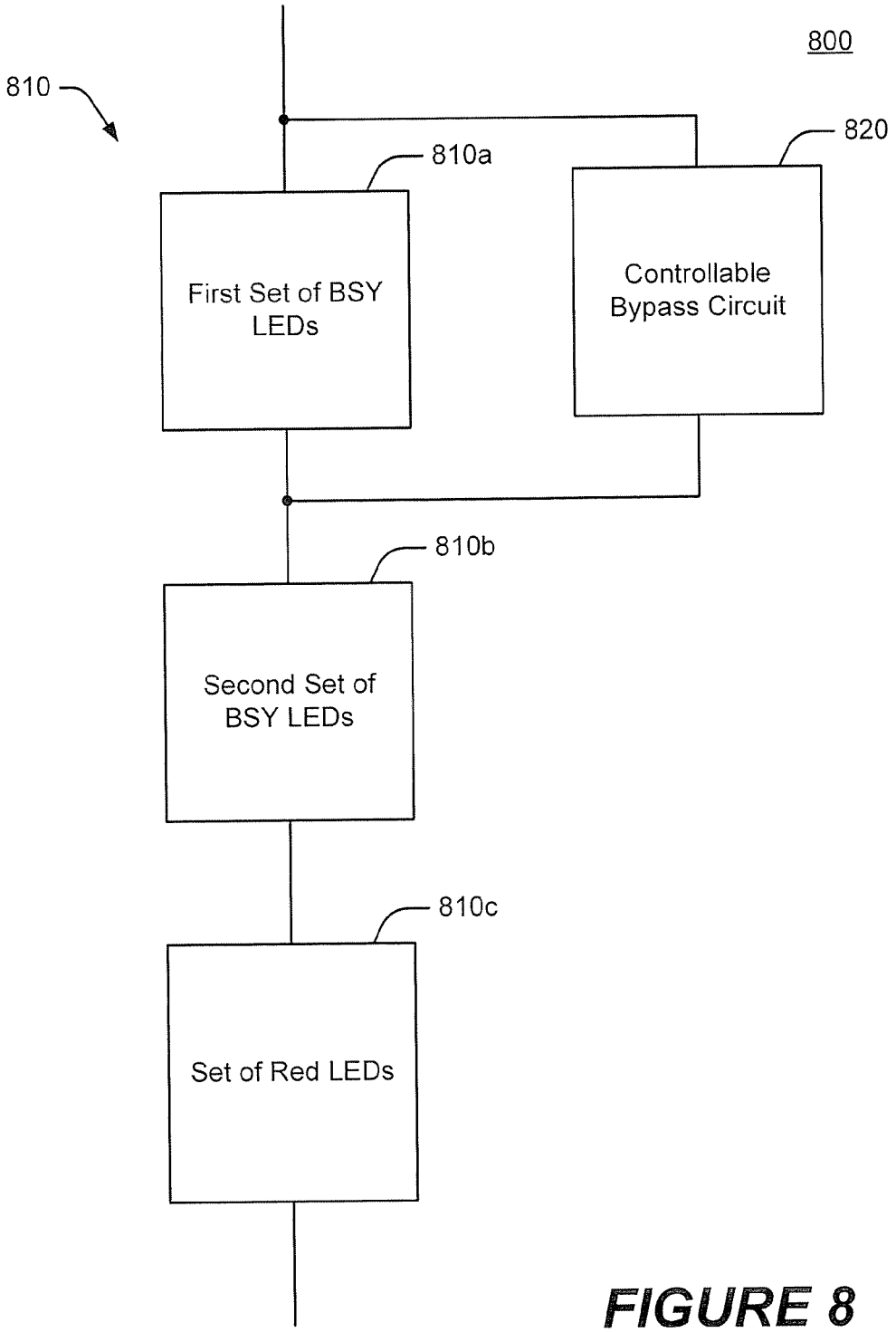

As illustrated in FIG. 8, in a lighting apparatus 800 according to some embodiments, a string may include first and second BSY color point sets 810*a*, 810*b*, along with a red color point set 810*c*. A controllable bypass circuit 820 is provided in parallel with only the first BSY color point set 810*a*. In other embodiments, more than one controllable bypass circuit could be employed, e.g., one for each of the first and second BSY color point groups 810*a*, 810*b*. Such a configuration may allow for moving the color point of the combined light output of the LED string 810 along a tie line between the color point of the first BSY color point set 810*a* and the color point of the second BSY color point set 810*b*. This may allow for further control of the color point of the string 810. In further embodiments, a controllable bypass circuit may be provided for the red color point set 810*c* as well.

It may be desirable that the amount of current diverted by a controllable bypass circuit be as little as possible, as current flowing through the bypass circuit may not be generating light and, therefore, may reduce overall system efficacy. Thus, the LEDs in a string may be preselected to provide a color point relatively close to a desired color point such that, when a final color point is fine tuned using a bypass circuit, the bypass circuit need only bypass a relatively small amount of current. Furthermore, it may be beneficial to place a bypass circuit in parallel with those LEDs of the string that are less constraining on the overall system efficacy, which may be those LEDs having the highest lumen output per watt of input power. For example, in the illustrated embodiments of FIGS. 7 and 8, red LEDs may be particularly limiting of overall system efficacy and, therefore, it may be desirable that a bypass circuit(s) be placed in parallel only with BSY portions of the LED string.

The amount of bypass current may be set at time of manufacture to tune an LED string to a specified color point when a load independent current is applied to the LED string. The mechanism by which the bypass current is set may depend on the particular configuration of the bypass circuit. For example, in embodiments in which a bypass circuit is a variable resistance circuit including, for example, a circuit using a bipolar or other transistor as a variable resistance, the amount of bypass current may be set by selection or trimming of a bias resistance. In further embodiments, the amount of bypass current may be adjusted according to a settable reference voltage, for example, a reference voltage set by zener zapping, according to a stored digital value, such as a value stored in a register or other memory device, and/or through sensing and/or or feedback mechanisms.

By providing a tunable LED module that operates from a load independent current source in a single string, power supplies for solid state lighting devices may also be less complex. Use of controllable bypass circuits may allow a wider range of LEDs from a manufacturer's range of LED color points to be used, as the control afforded by a bypass circuit may be used to compensate for color point variation. Some embodiments of the present inventive subject matter may provide an LED lighting apparatus that may be readily incorporated, e.g., as a replaceable module, into a lighting device without requiring detailed knowledge of how to control the current through the various color LEDs to provide a desired color point. For example, some embodiments of the present inventive subject matter may provide a lighting module that contains different color point LEDs but that may be used in an application as if all the LEDs were a single color or even a single LED. Also, because such an LED module may be tuned at the time of manufacture, a desired color point may be achieved from a wide variety of LEDs with different color points. Thus, a wider range of LEDs from a manufacturing distribution may be used to make a desirable color point than might be achievable through the LED manufacturing process alone.

Examples of the present inventive subject matter are described herein with reference to the different color point LEDs being BSY and red, however, the present inventive subject matter may be used with other combinations of different color point LEDs. For example, BSY and red with a supplemental color such as described in U.S. patent application Ser. No. 12/248,220, entitled "LIGHTING DEVICE AND METHOD OF MAKING" filed Oct. 9, 2008, may be used. Other possible color combinations include, but are not limited to, red, green and blue LEDs, red, green, blue and white LEDs and different color temperature white LEDs. Also, some embodiments of the present inventive subject are described with reference to the generation of white light, but light with a different aggregate color point may be provided according to some embodiments of the present inventive subject matter.

In addition or alternatively, controllable bypass circuits may be used for other aspects of controlling the color point of the single string of LEDs. For example, controllable bypass circuits may be used to provide thermal compensation for LEDs for which the output changes with temperature. For example, a thermistor may be incorporated in a linear bypass circuit to either increase or decrease the current through the bypassed LEDs with temperature. In specific embodiments, the current flow controller may divert little or no current when the LEDs have reached a steady state operating temperature such that, at thermal equilibrium, the bypass circuit would consume a relatively small amount of power to maintain overall system efficiency. Other temperature compensation techniques using other thermal measurement/control devices may be used in other embodiments. For example, a thermocouple may be used to directly measure at a temperature sensing location and this temperature information used to control the amount of bypass current. Other techniques, such as taking advantage of thermal properties of transistor, could also be utilized.

According to further aspects of the present inventive subject matter, a bypass circuit may be used to maintain a predetermined color point in the presence of changes to the current passing through an LED string, such as current changes arising from a dimmer or other control. For example, many phosphor-converted LEDs may change color as the current through them is decreased. A bypass circuit may be used to alter the current through these LEDs or through other LEDs in a string as the overall current decreases so as to maintain the color point of the LED string. Such a compensation for changes in the input current level may be beneficial, for example, in a linear dimming application in which the current through the string is reduced to dim the output of the string. In further embodiments, current through selected sets of LEDs could be changed to alter the color point of an LED string. For example, current through a red string could be increased when overall current is decreased to make the light output seem warmer as it is dimmed.

A bypass circuit according to some embodiments of the present inventive subject matter may also be utilized to provide lumen depreciation compensation. As a typical phosphor converted LED is used over a long period of time (thousands of hours), its lumen output for a given current may decrease. To compensate for this lumen depreciation, a bypass circuit may sense the quantity of light output, the duration and temperature of operation or other characteristic indicative of potential or measured lumen depreciation and control bypass current to increase current through affected LEDs and/or route current through additional LEDs to maintain a relatively constant lumen output. Different actions in routing current may be taken based, for example, on the type and/or color point of the LEDs used in the string of LEDs.

In a string of LEDs including LEDs with different color points, the level of current at which the different LEDs output light may differ because of, for example, different material characteristics or circuit configurations. For example, referring to FIG. 7, the BSY color point set 710*a* may include LEDs that output light at a different current than the LEDs in the red color point set 710*b*. Thus, as the current through the string 710 is reduced, the LEDs in the red color point set 710*b* may turn off sooner than the LEDs in the BSY color point set 710*a*. This can result in an undesirable shift in color of the light output of the LED string 710, for example, when dimming. The bypass circuit 720 may be used to bypass current around the BSY color point set 710*a* when the overall string current I falls to a level where the LEDs of the red color point set 710*b* substantially cease output of light. Similarly, if the output of the different LEDs differs with differing string current I, the bypass circuit 720 may be used to increase and/or decrease the current through the LEDs so that the light output of the differing LEDs adjusts with the same proportion to current. In such a manner, the single string 710 may act like a single LED with the color point of the combined output of the LEDs in the string.

Further embodiments of the present inventive subject matter provide lighting apparatus that may be used as a self contained module that can be connected to a relatively standard power supply and perform as if the string of LEDs therein is a single component. Bypass circuits in such a module may be self powered, e.g., biased or otherwise powered from the same power source as the LED string. Such self-powered bypass circuits may also be configured to operate without reference to a ground, allowing modules to be interconnected in parallel or serial arrays to provide different lumen outputs. For example, two modules could be connected in series to provide twice the lumen output as the two modules in series would appear as a single LED string.

Bypass circuits may also be controlled responsive to various control inputs, separately or in combination. In some embodiments, separate bypass circuits that are responsive to different parameters associated with an LED string may be paralleled to provide multiple adjustment functions. For example, in a string including BSY and red LEDs along the lines discussed above with reference to FIGS. 7 and 8, temperature compensation of red LEDs achieved by reducing current through BSY LEDs may be combined with tuning input control of current through the BSY LEDs that sets a desired nominal color point for the string. Such combined control may be achieved, for example, by connecting a bypass circuit that sets the color point in response to an external input in parallel with a bypass circuit that compensates for temperature.

Some embodiments of the present inventive subject matter provide fabrication methods that include color point adjustment using one or more bypass circuits. Using the adjustment capabilities provided by bypass circuits, different combinations of color point bin LEDs can be used to achieve the same final color point, which can increase flexibility in manufacturing and improve LED yields. The design of power supplies and control systems may also be simplified.

Figure 9:
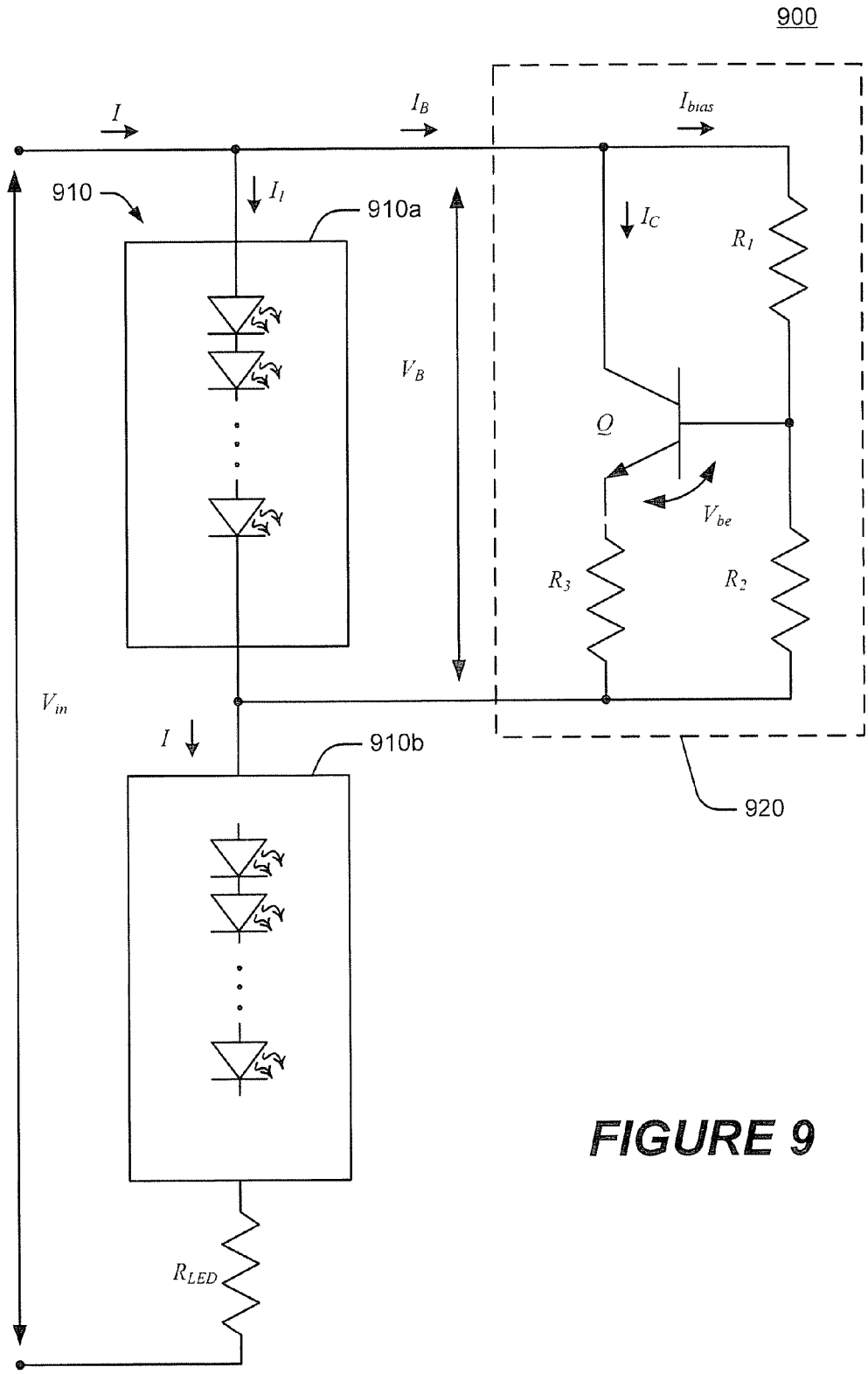
FIG. 9 illustrates a lighting apparatus with a variable resistance bypass circuit according to some embodiments of the present inventive subject matter.

As noted above, various types of bypass circuits may be employed to provide the single string of LEDs with color control. FIG. 9 illustrates a lighting apparatus 900 according to some embodiments of the present inventive subject matter. The apparatus 900 includes a string 910 of LEDs including first and second sets 910*a*, 910*b*, and a bypass circuit 920 that may be used to set the color point for the LED string 910. The first and second sets 910*a*, 910*b* may correspond, for example, to BSY and red color point groups. The number of LEDs shown is for purposes of illustration, and the number of LEDs in each set 910*a*, 910*b* may vary, depending on such factors as the desired total lumen output, the particular LEDs used, the binning structure of the LEDs and/or the input voltage/current.

In FIG. 9, a voltage source provides a constant input voltage $V_{in}$. The constant voltage $V_{in}$ is turned into a constant current I through the use of the current limiting resistor $R_{LED}$. In other words, if $V_{in}$ is constant, the voltage across the LED string 910 is set by the forward voltages of the LEDs of the string 910 and, thus, the voltage across the resistor $R_{LED}$ will be substantially constant and the current I through the string 910 will also be substantially constant per Ohm's law. Thus, the overall current, and therefore the lumen output, may be set for the lighting apparatus 900 by the resistor $R_{LED}$. Each lighting apparatus 900 may be individually tuned for lumen output by selecting the value of the resistor $R_{LED}$ based on the characteristics of the individual LEDs in the lighting apparatus 900. The current $I_1$ through the first set 910*a* of LEDs and the current $I_B$ through the bypass circuit 920 sum to provide the total current I:

$$I=I_1+I_B.$$

Accordingly, a change in the bypass current $I_B$ will result in an opposite change in the current $I_1$ through the first set 910*a* of LEDs. Alternatively, a constant current source could be utilized and $R_{LED}$ could be eliminated, while using the same control strategy.

Still referring to FIG. 9, the bypass circuit 920 includes a transistor Q1, resistors $R_1$, $R_2$ and $R_3$. The resistor $R_2$ may be, for example, a thermistor, which may provide the bypass circuit 920 with the ability to provide thermal compensation. If thermal compensation is not desired, the resistor $R_2$ could be a fixed resistor. As long as current flows through the string 910 of LEDs (i.e., $V_{in}$ is greater than the sum of the forward voltages of the LEDs in the string 910), the voltage $V_B$ across the terminals of the bypass circuit 920 will be fixed at the sum of the forward voltages of the LEDs in the first set 910*a* of LEDs. Assuming:

$$(\beta+1)R_3>>R_1\|R_2,$$

then the collector current through the transistor Q1 may be approximated by:

$$I_C=(V_B/(1+R_1/R_2)-V_{be})/R_3,$$

where $R_1\|R_2$ is the equivalent resistance of the parallel combination of the resistor $R_1$ and the resistor $R_2$ and $V_{be}$ is the base-to-emitter voltage of the transistor Q1. The bias current $I_{bias}$ may be assumed to be approximately equal to $V_B/(R_1+R_2)$, so the bypass current $I_B$ may be given by:

$$I_B=I_C+I_{bias}=(V_B/(1+R_1/R_2)-V_{be})/R_3+V_B(R_1+R_2).$$

If the resistor $R_2$ is a thermistor, its resistance may be expressed as a function of temperature, such that the bypass current $I_B$ also is a function of temperature.

Additional embodiments provide lighting apparatus including a bypass circuit incorporating a switch controlled by a pulse width modulation (PWM) controller circuit. In some embodiments, such a bypass circuit may be selectively placed in various locations in a string of LEDs without requiring a connection to a circuit ground. In some embodiments, several such bypass circuits may be connected to a string to provide control on more than one color space axis, e.g., by arranging such bypass circuits in a series and/or hierarchical structure. Such bypass circuits may be implemented, for example, using an arrangement of discrete components, as a separate integrated circuit, or embedded in an integrated multiple-LED package. In some embodiments, such a bypass circuit may be used to achieve a desired color point and to maintain that color point over variations in current and/or temperature. As with other types of bypass circuits discussed above, it may also include means for accepting control signals from, and providing feedback to, external circuitry. This external circuitry could include a driver circuit, a tuning circuit, or other control circuitry.

Figure 10:
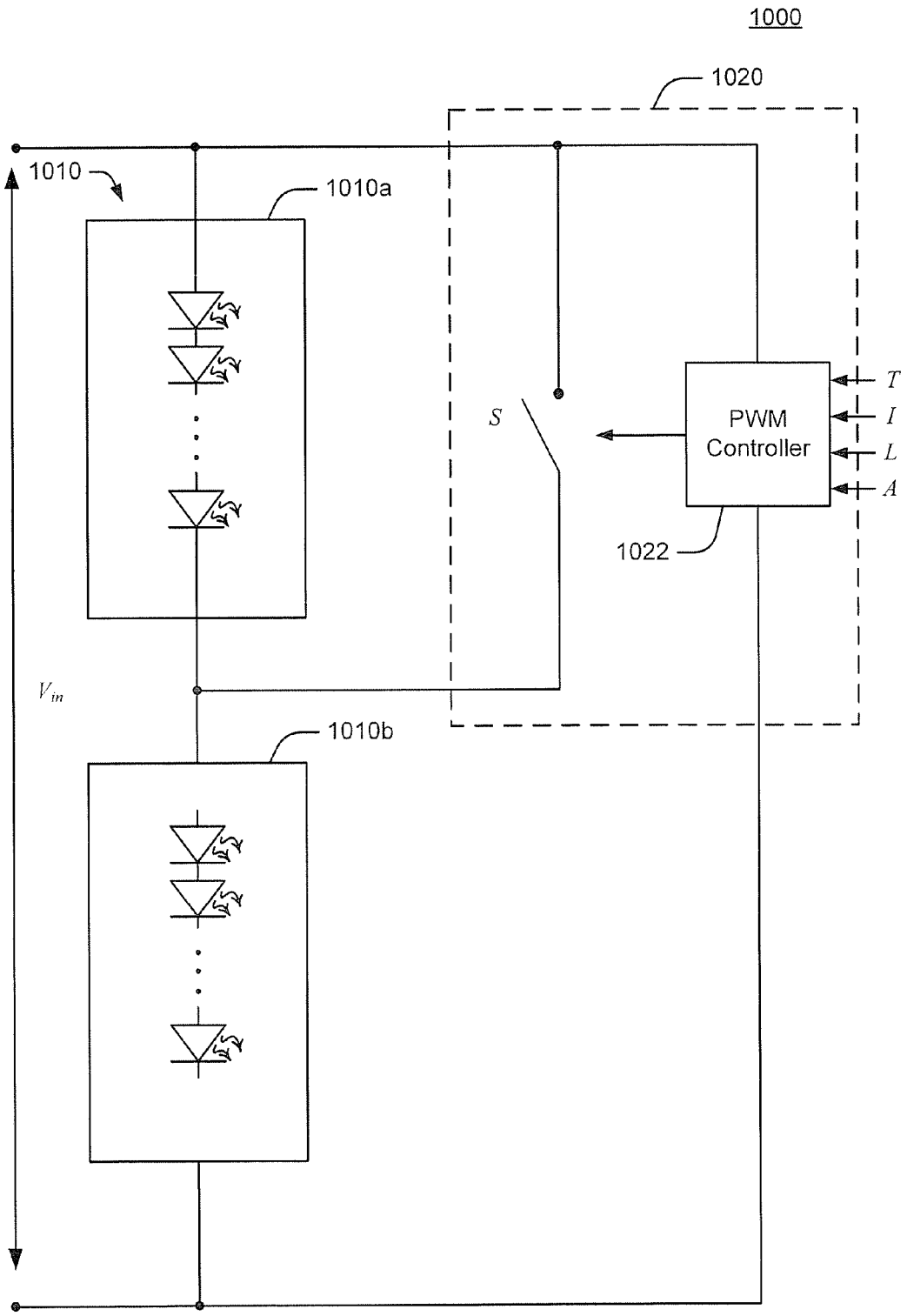
FIGS. 10 and 11 illustrate lighting apparatus with a pulse width modulated bypass circuits according to some embodiments of the present inventive subject matter.

FIG. 10 illustrates a lighting apparatus 1000 including a string of LED's 1010 including first and second sets 1010*a*, 1010*b* of LEDs. A bypass circuit 1020 is connected in parallel with the first set 1010*a* of LEDs and includes a switch S that is controlled by a PWM controller circuit 1022. As shown, the PWM controller circuit 1022 may control the switch S responsive to a variety of control inputs, such as temperature T, string current I, light L (e.g., light output of the string 1010 or some other source) and/or an adjustment input A, such as may be provided during a calibration procedure. The PWM controller circuit 1022 may include, for example, a microprocessor, microcontroller or other processor that receives signals representative of the temperature T, the string current I and/or the tuning input Tune from various sensors, and responsively generates a PWM signal that drives the switch S.

Figure 11:
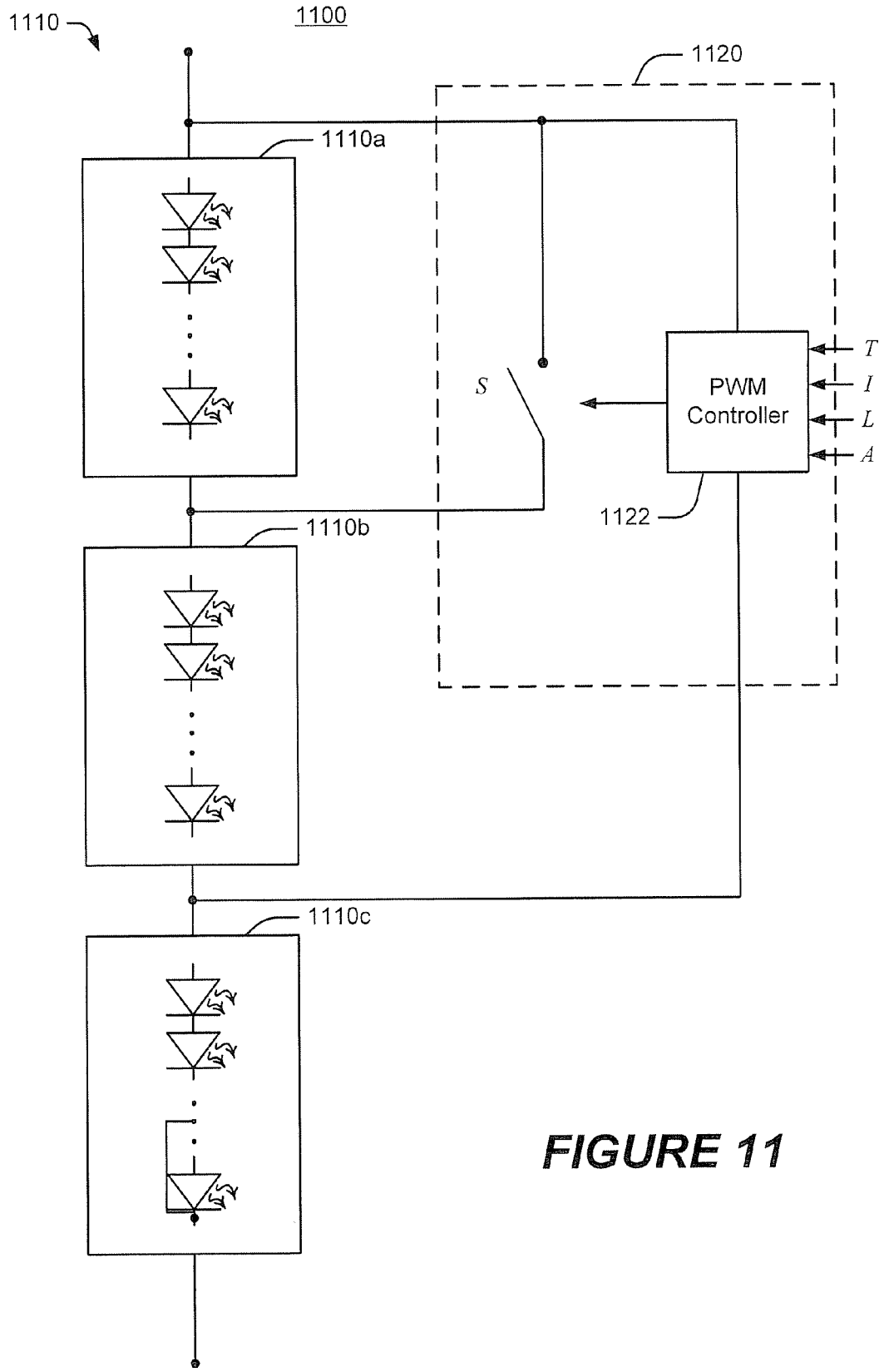

In the embodiments illustrated in FIG. 10, the PWM controller circuit 1022 has power input terminals connected across the string 1010, such that it may be powered by the same power source that powers the string 1010. In embodiments of the present inventive subject matter illustrated in FIG. 11, a lighting device 1100 includes a string 1110 including first, second and third sets 1110*a*, 1110*b*, 1110*c*. A bypass circuit 1120 is configured to bypass the first set 1110*a*, and includes a PWM controller circuit 1122 having power terminals connected across the first and second sets 1110*a*, 1110*b*, 1110*c*. Such a configuration may be used, for example, to provide a module that may be coupled to or more internal nodes of a string without requiring reference to a circuit ground, with the second set 1110*b* of LEDs providing sufficient forward voltage to power the PWM controller circuit 1122.

Figure 12:
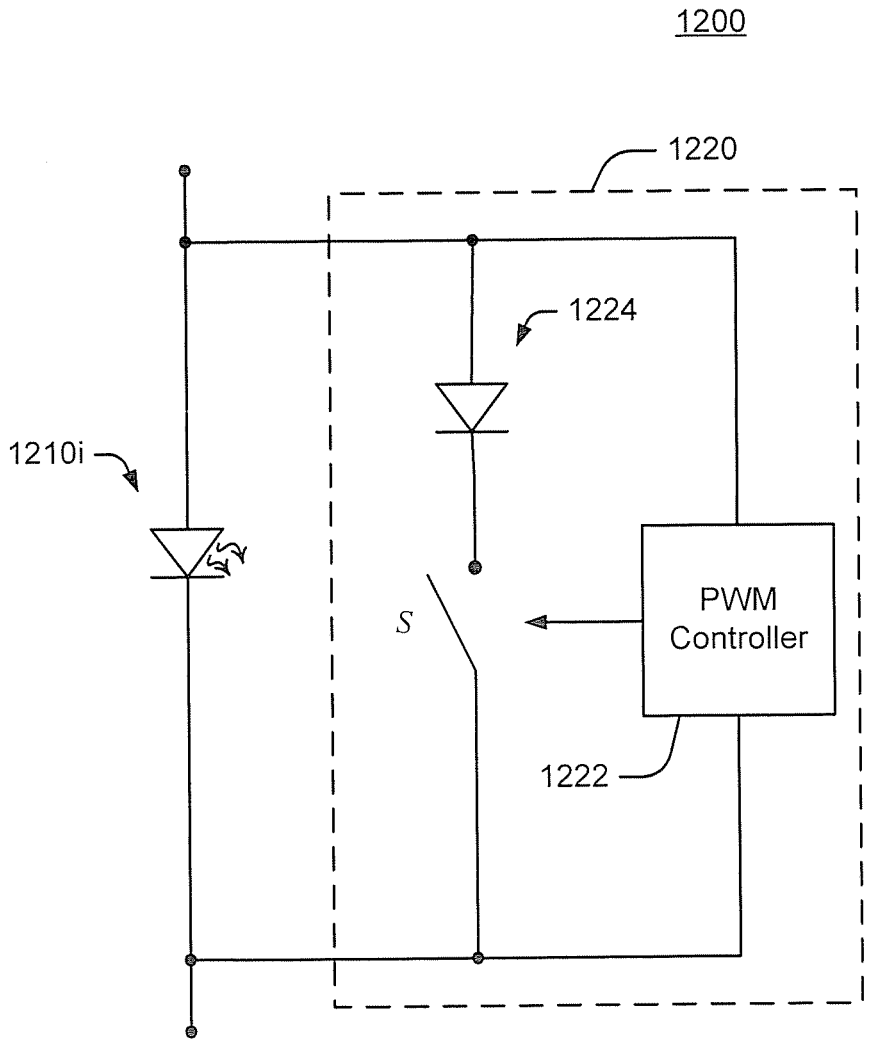
FIG. 12 illustrates a lighting apparatus with a pulse width modulated bypass circuit with an ancillary diode according to some embodiments of the present inventive subject matter.

According to further embodiments of the present inventive subject matter, a bypass switch may include an ancillary diode through which bypass current is diverted. For example, FIG. 12 illustrates a lighting apparatus including an LED set 1210*i* (e.g., a portion of an LED string including multiple serially connected LED sets) having one or more LEDs, across which a bypass circuit 1220 is connected. The bypass circuit 1220 includes a switch S connected in series with an ancillary diode set 1224, which may include one or more emitting diodes (e.g., LEDs or diodes emitting energy outside the visible range, such as energy in the infrared, ultraviolet or other portions of the spectrum) and/or one or more non-emitting diodes. Such an ancillary diode set 1224 may be used, for example, to provide a compensatory LED output (e.g., an output of a different color point) and/or to provide other ancillary functions, such as signaling (e.g., using infrared or ultraviolet). The ancillary diode set may be provided so that switching in the ancillary diode set does not substantially affect the overall string voltage. A PWM controller circuit 1222 controls the switch S to control diversion of current through the ancillary diode set 1224. The PWM controller circuit 1222 may be powered by the forward voltages across the diode set 1210*i* and the ancillary diode set 1224. The ancillary diode set 1224 has a forward voltage lower than that of the LED set 1210*i*, but high enough to power the PWM controller circuit 1222.

Figure 13:
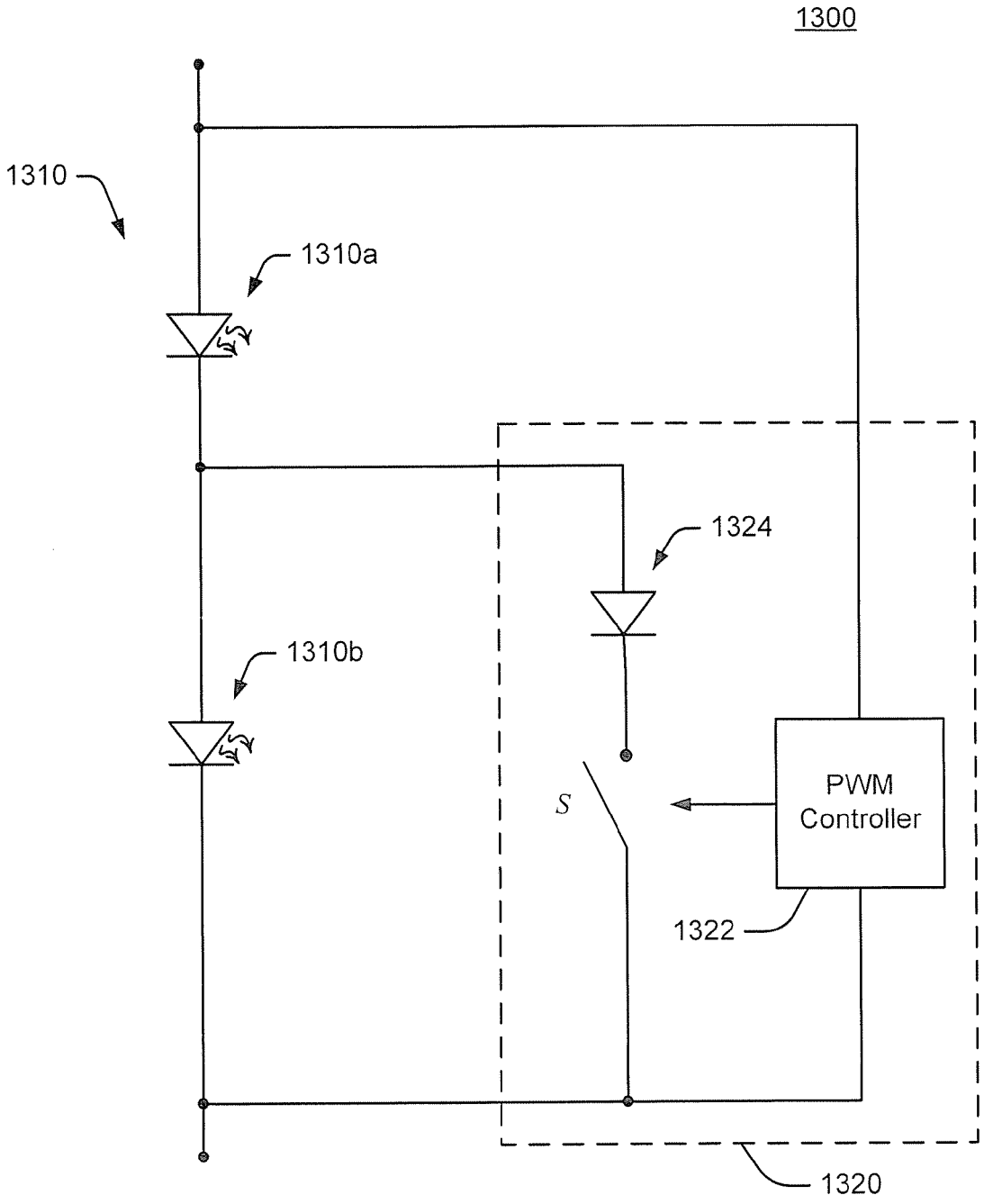
FIG. 13 illustrates a lighting apparatus with a string-powered pulse width modulated bypass circuit with an ancillary diode according to some embodiments of the present inventive subject matter.

FIG. 13 illustrates a lighting apparatus 1300 having an LED string 1310 including first and second sets 1310*a*, 1310*b* of LEDs. A bypass circuit 1320 is connected across the second set 1310*b* of LEDs, and includes a bypass path including a switch S connected in series with an ancillary diode set 1324. The forward voltage of the ancillary diode set 1324 may be less than that of the second set of diodes 1310*b*, and the sum of the forward voltages of the ancillary diode set 1324 and the first set 1310*a* of LEDs may be great enough to power a PWM controller circuit 1322 of the bypass circuit 1320.

Figure 14:
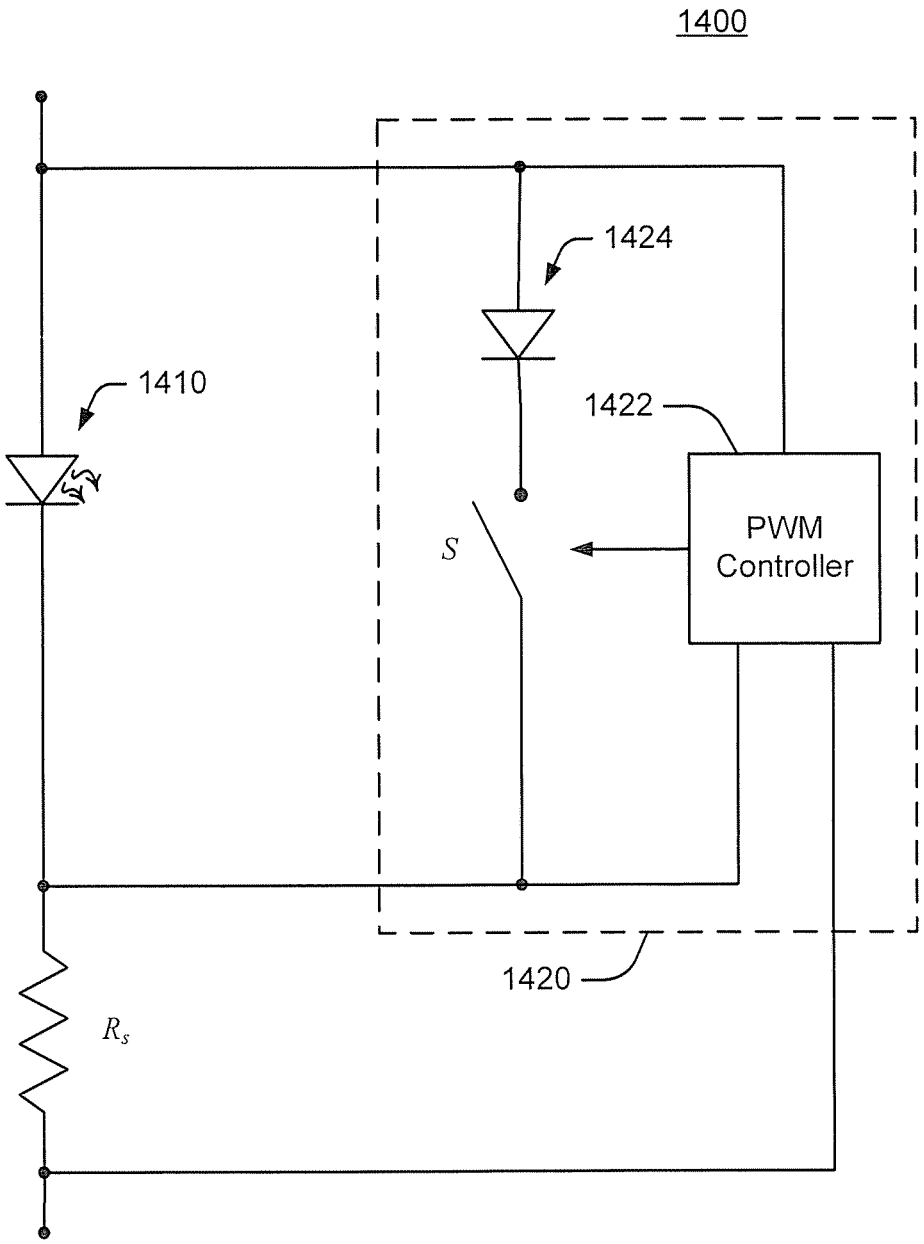
FIG. 14 illustrates a lighting apparatus with a current-sensing pulse width modulated bypass circuit according to some embodiments of the present inventive subject matter.

FIG. 14 illustrates a lighting apparatus 1400 including a bypass circuit 1420 that bypass current around an LED set 1410*i* (e.g., a portion of a string containing multiple serially connected sets of LEDs) via an ancillary diode set 1424 using a PWM controlled switch S. The bypass circuit 1420 includes a PWM controller circuit 1422 that controls the switch S responsive to a current sense signal (voltage) $V_{sense}$ developed by a current sense resistor $R_{sense}$ connected in series with the LED set 1410*i*. Such an arrangement allows the PWM duty cycle to be adjusted to compensate for variations in the string current I. An internal or external temperature sensor could be used in conjunction with such current-based control to adjust the duty cycle as well.

Figure 15:
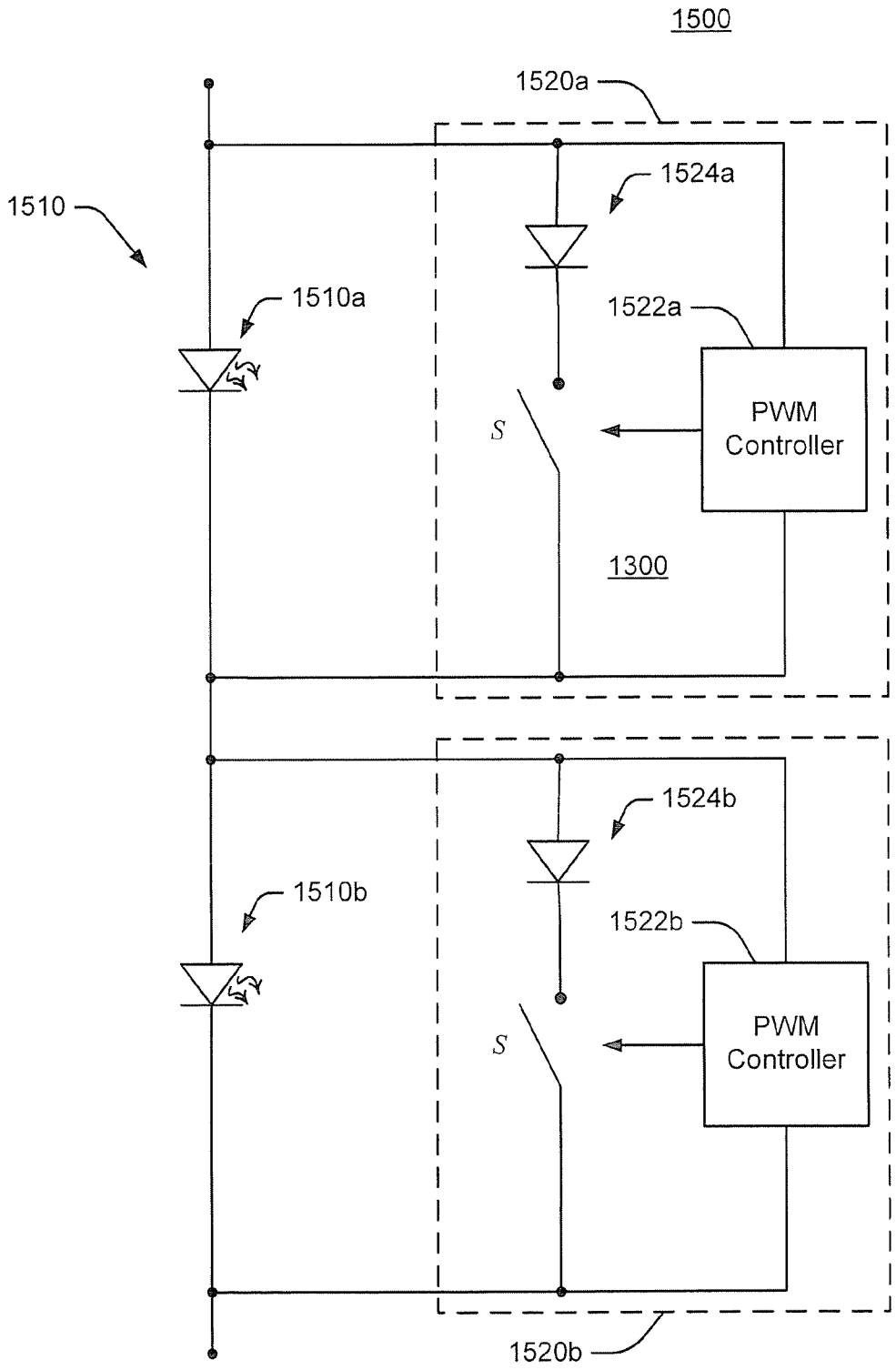
FIG. 15 illustrates a lighting apparatus with multiple pulse width modulated bypass circuits according to some embodiments of the present inventive subject matter.

As noted above, different types of control inputs for bypass circuits may be used in combination. For example, FIG. 15 illustrates a lighting apparatus 1500 including an LED string 1510 including respective first and second LED sets 1510*a*, 1510*b* having respective bypass circuits 1520*a*, 1520*b* connected thereto. The bypass circuits 1520*a*, 1520*b* each include a series combination of an ancillary diode set 1524*a*, 1524*b* and a switch Sa, Sb controlled by a PWM controller circuit 1522*a*, 1522*b*. The ancillary diode sets 1524*a*, 1524*b* may have the same or different characteristics, e.g., may provide different wavelength light emissions. The PWM controller circuits 1522*a*, 1522*b* may operate in the same or different manners. For example, one of the controllers 1522*a*, 1522*b* may operate responsive to temperature, while another of the controllers may operate responsive to an externally-supplied tuning input.

Figure 16:
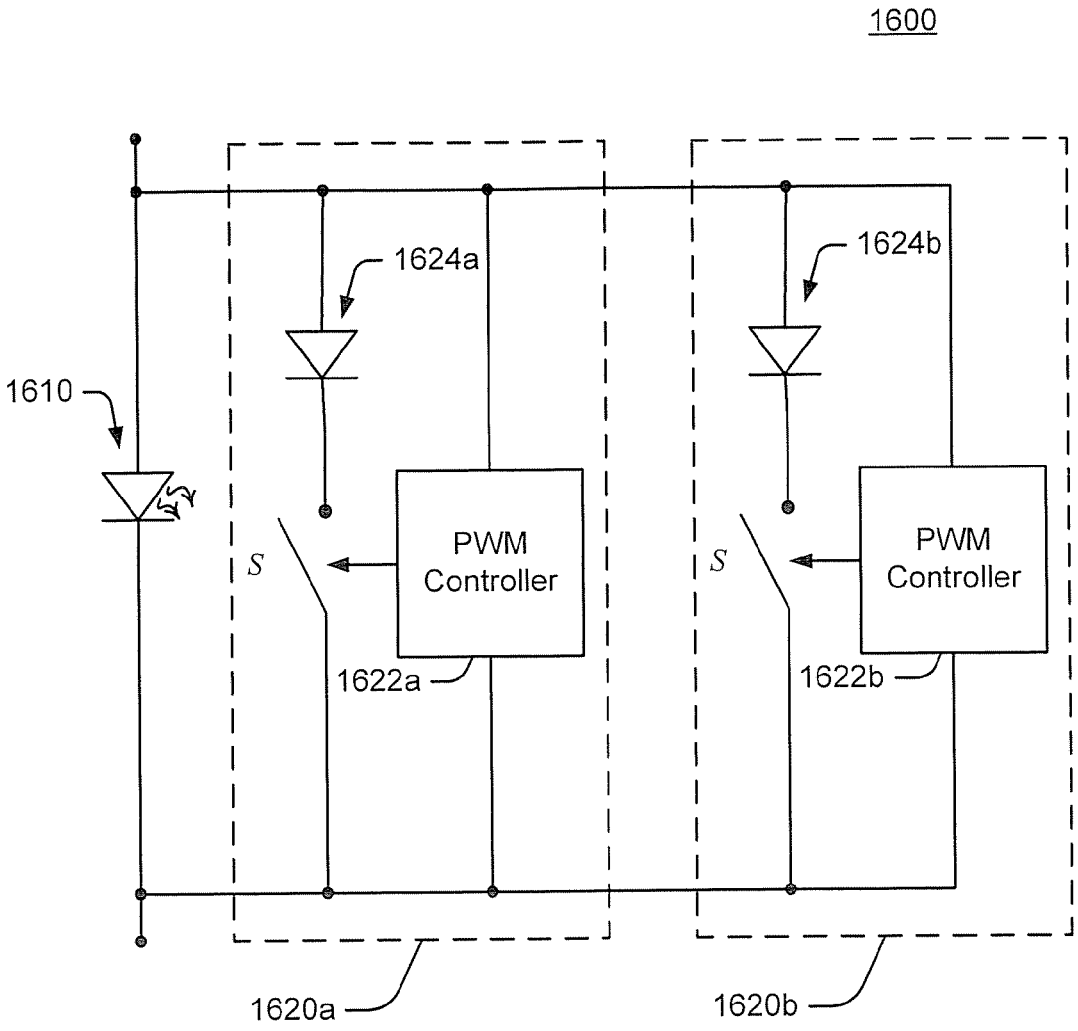
FIG. 16 illustrates a lighting apparatus with parallel pulse width modulated bypass circuits according to some embodiments of the present inventive subject matter.

Several instances of such bypass circuits could also be nested within one another. For example, FIG. 16 illustrates a lighting apparatus 1600 including an LED set 1610*i* and first and second bypass circuits 1620*a*, 1620*b* connected in parallel with the LED set 1610*i*. The first and second bypass circuits 1620*a*, 1620*b* include respective first and second ancillary diode sets 1624*a*, 1624*b* connected in series with respective first and second switches Sa, Sb that are controlled by respective first and second PWM controller circuits 1622*a*, 1622*b*. In some embodiments, this arrangement may be hierarchical, with the first ancillary diode set 1624*a* having the lowest forward voltage and the LED set 1610*i* having the highest forward voltage. Thus, the first bypass circuit 1620*a* (the "dominant" bypass circuit) overrides the second bypass circuit 1620*b* (the "subordinate" bypass circuit). The second bypass circuit 1620*b* may operate when the switch Sa of the first bypass circuit 1620*a* is open. It may be necessary for the dominant bypass circuit to utilize a sufficiently lower PWM frequency than the subordinate bypass circuit so as to avoid seeing a color fluctuation due to interference of the two frequencies.

It will be appreciated that various modifications of the circuitry shown in FIGS. 2-16 may be provided in further embodiments of the present inventive subject matter. For example, the PWM-controlled switches shown in FIGS. 12-16 could be replaced by variable resistance elements (e.g., a transistor controlled in a linear manner along the lines of the transistor Q in the circuit of FIG. 9). In some embodiments, linear and PWM-based bypass circuits may be combined. For example, a linear bypass circuit along the lines discussed above with reference to FIG. 9 could be used to provide temperature compensation, while employing a PWM-based bypass circuit to support calibration or tuning. In still further embodiments, a linear temperature compensation bypass circuit along the lines discussed above with reference to FIG. 9 may be used in conjunction with a PWM-based temperature compensation circuit such that, at string current levels below a certain threshold, the PWM-based bypass circuit would override the linear bypass circuit. It will be further appreciated that the present inventive subject matter is applicable to lighting fixtures or other lighting devices including single strings or multiple strings of light emitting devices controlled along the lines described above.

Figure 17:
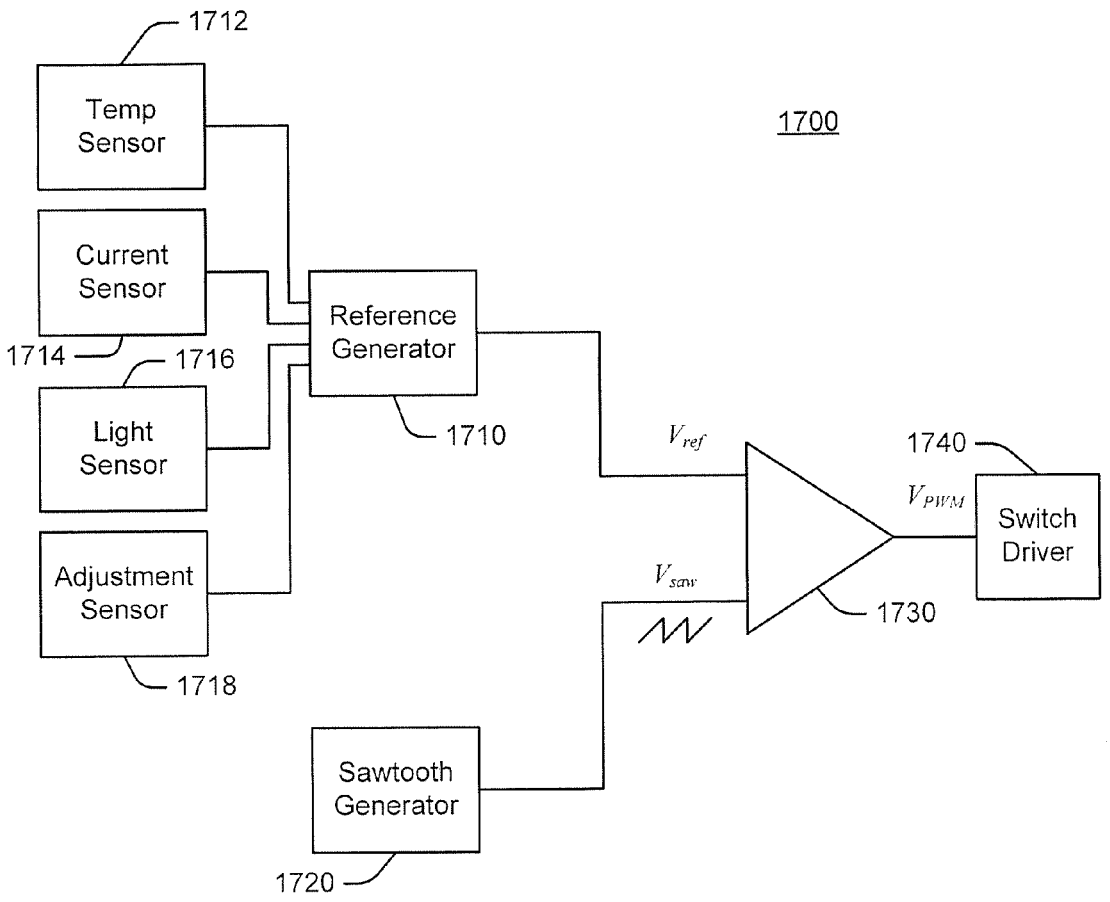
FIG. 17 illustrates a multi-input PWM control circuit for a lighting apparatus with a pulse width modulated bypass circuit according to some embodiments of the present inventive subject matter.

FIG. 17 illustrates an exemplary PWM controller circuit 1700 that could be used in the circuits shown in FIGS. 10-16 according to some embodiments of the present inventive subject matter. The PWM controller circuit 1700 includes a reference signal generator circuit 1710 that receives input signals from sensors, here shown as including a temperature sensor 1712, a string current sensor 1714, a light sensor 1716 and an adjustment sensor 1718. The reference signal generator circuit 1710 responsively produces a reference signal $V_{ref}$ that is applied to a first input of a comparator circuit 1730. A sawtooth generator circuit 1720 generates a sawtooth signal $V_{saw}$ that is applied to a second input of the comparator circuit 1730, which produces a pulse-width modulated control signal $V_{PWM}$ based on a comparison of the reference signal $V_{ref}$ and the sawtooth signal $V_{saw}$. The pulse-width modulated control signal $V_{PWM}$ may be applied to a switch driver circuit 1740 that drives a switch, such as the switches shown in FIGS. 10-16.

Figure 18:
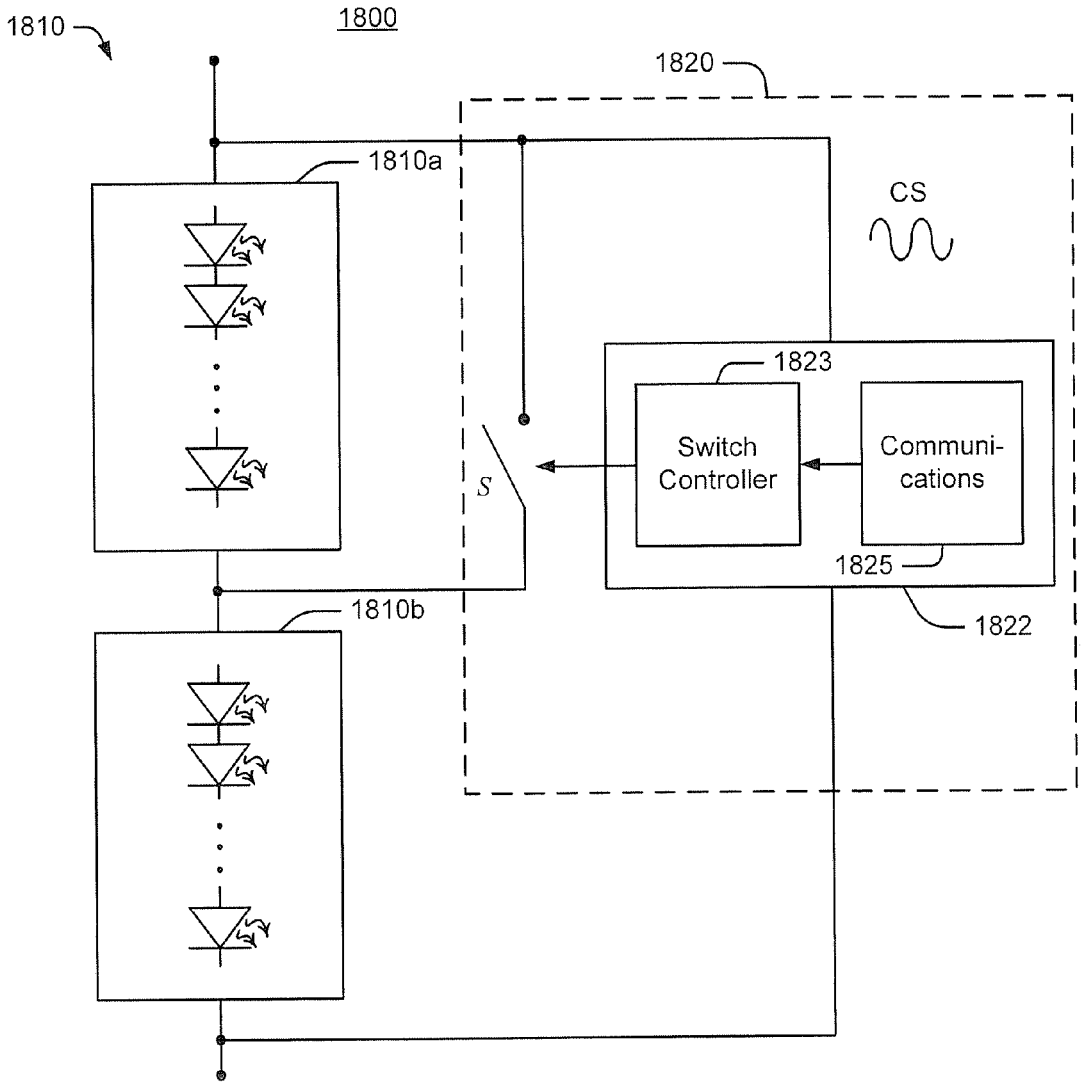
FIG. 18 illustrates a lighting apparatus including a PWM controller circuit with communications capability according to further embodiments of the present inventive subject matter.

According to yet further aspects of the present inventive subject matter, a bypass circuit along the lines discussed above may also have the capability to receive information, such as tuning control signals, over the LED string it controls. For example, FIG. 18 illustrates a lighting apparatus 1800 including an LED string 1810 including first and second sets 1810*a*, 1810*b* of LEDs. The first set 1810*a* of LEDs has a bypass circuit 1820 connected in parallel. The bypass circuit 1820 includes a switch S controlled by a PWM controller circuit 1822. As illustrated, the PWM controller circuit 1822 includes a communications circuit 1825 and a switch controller circuit 1823. The communications circuit 1825 may be configured, for example, to receive a control signal CS propagated over the LED string 1810. For example, the control signal CS may be a carrier-modulated signal that conveys tuning commands or other information to the communications circuit 1825 (e.g., in the form of digital bit patterns), and the communications circuit 1825 may be configured to receive such a communications signal. The received information may be used, for example, to control the switch controller circuit 1823 to maintain a desired bypass current through the bypass circuit 1820. It will be appreciated that similar communications circuitry may be incorporated in variable resistance-type bypass circuits.

Figure 19:
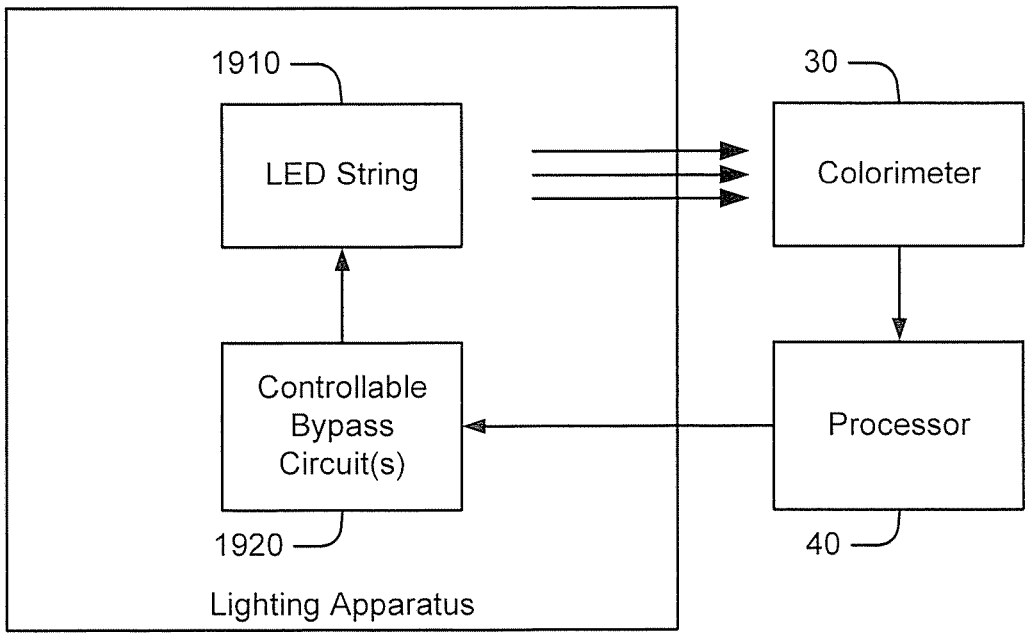
FIG. 19 illustrates a lighting apparatus including one or more controllable bypass circuits that operate responsive to a colorimeter according to further embodiments of the present inventive subject matter.
Figure 20:
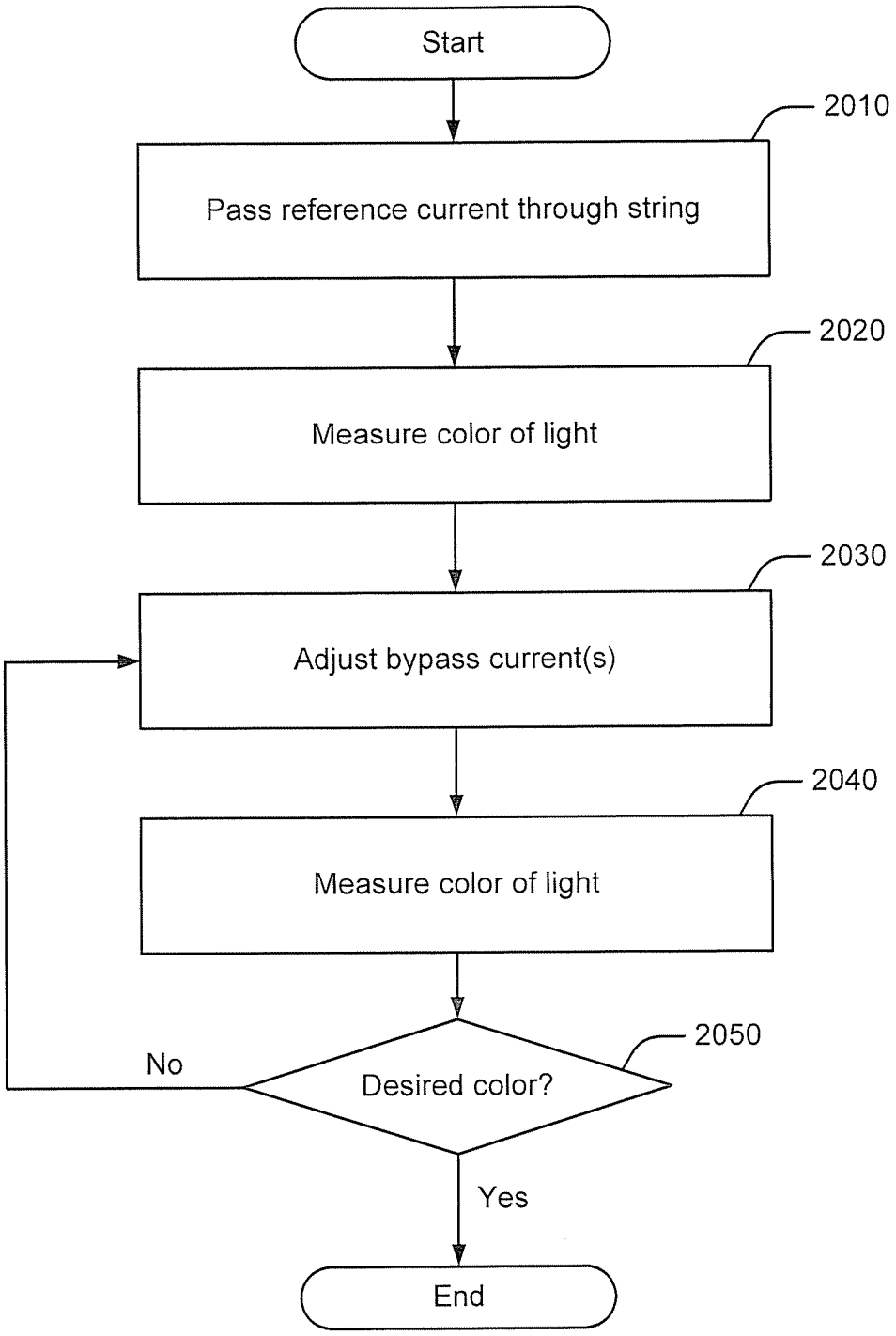
FIG. 20 illustrates operations for controlling bypass currents to produce a desired light color according to further embodiments of the present inventive subject matter.

FIGS. 19 and 20 illustrate systems/methods for calibration of a lighting apparatus 1900 according to some embodiments of the present inventive subject matter. The lighting apparatus 1900 includes an LED string 1910 and one or more controllable bypass circuits 1920, which may take one of the forms discussed above. As shown, the controllable bypass circuit(s) 1920 is configured to communicate with a processor 40, i.e., to receive adjustment inputs therefrom. Light generated by the LED string 1910 is detected by a colorimeter 30, for example, a PR-650 SpectraScan® Colorimeter from Photo Research Inc., which can be used to make direct measurements of luminance, CIE Chromaticity (1931 xy and 1976 u'V') and/or correlated color temperature. A color point of the light may be detected by the colorimeter 30 and communicated to the processor 40. In response to the detected color point of the light, the processor 40 may vary the control input provided to the controllable bypass circuit (s) 1920 to adjust a color point of the LED string 1910. For example, along lines discussed above, the LED string 1910 may include sets of BSY and red LEDs, and the control input provided to the controllable bypass circuit(s) 1920 may selectively bypass current around one or more of the BSY LEDs.

Referring to FIG. 20, calibration operations for the lighting apparatus 1900 of FIG. 19 may begin with passing a reference current (e.g., a nominal expected operating current) through the LED string 1910 (block 2010). The light output by the string 1910 in response to the reference current is measured (block 2020). Based on the measured light, the processor 40 adjusts the bypass current(s) controlled by the controllable bypass circuit(s) 1920 (block 2030). The light color is measured again (block 2040) and, if it is determined that a desired color is yet to be achieved (block 2050), the processor 40 again causes the controllable bypass circuit(s) 1920 to further adjust the bypass current(s) (block 2030). The calibration process may be terminated once a desired color is achieved.

In various embodiments of the present inventive subject matter, such calibration may be done in a factory setting and/or in situ. In addition, such a calibration procedure may be performed to set a nominal color point, and further variation of bypass current(s) may subsequently be performed responsive to other factors, such as temperature changes, light output changes and/or string current changes arising from dimming and other operations, along the lines discussed above.

Figure 21:
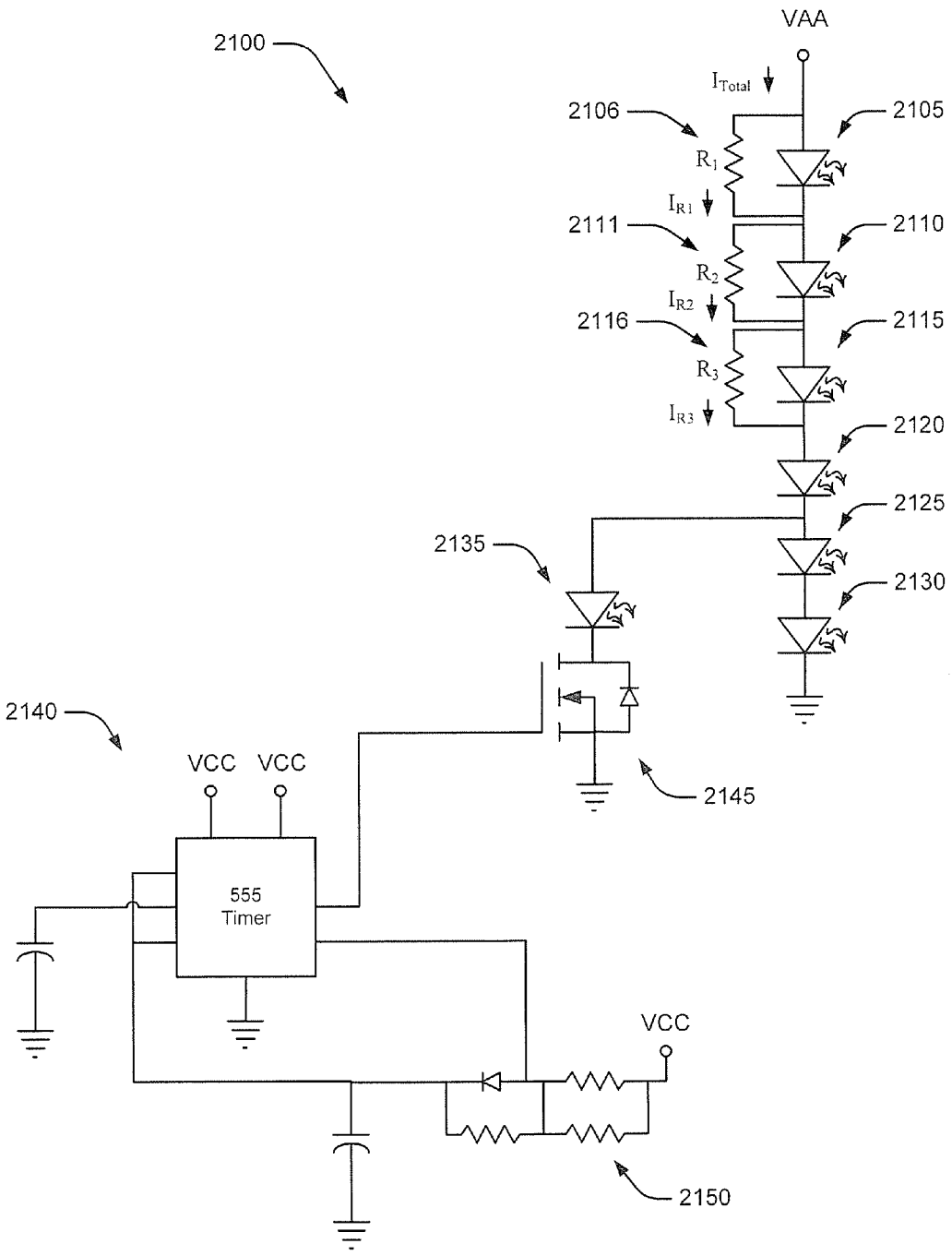
FIG. 21 illustrates a lighting apparatus with fixed bypass circuitry and controllable bypass circuitry according to some embodiments of the present inventive subject matter.

FIG. 21 illustrates a lighting apparatus 2100 incorporating further embodiments of the present inventive subject matter. As seen in FIG. 19, a string of LEDs includes serially interconnected device sets, including BSY LED sets 2105, 2110, 2115 red LED sets 2120, 2125, 2130. The BSY LED sets 2105, 2110 and 2115 have corresponding fixed bypass circuits 2106, 2111, 2116 (resistors $R_1$, $R_2$, $R_3$). The red LED device sets 2125 and 2130 have a corresponding controllable bypass circuit including a timer circuit 2140 controlled responsive to a negative temperature coefficient thermistor 2150, a switch 2145 controlled by the timer circuit 2140 and an ancillary BSY LED 2135.

The fixed bypass circuits 2106, 2111 and 2116 are provided to compensate for changes in color that may result when linear dimming is performed on the string of LEDs. In linear dimming, the total current $I_{total}$ through the string is reduced to dim the output of the LEDs. The addition of the fixed resistance values in the bypass circuits 2106, 2111, 2116 provides a reduction in LED current that increases at a rate that is greater than the rate at which the total current $I_{total}$ is reduced. For example, in FIG. 21, the currents $I_{R1}$, $I_{R2}$, $I_{R3}$ through the fixed resistors $R_1$, $R_2$, $R_3$ are based on the forward voltage drop across the BSY LED sets 2105, 2110 and 2115 and are, therefore, substantially fixed. The current through the red LED 2120 is equal to the total current $I_{Total}$ through the string. The current through the red LED sets 2125, 2130 is equal to the total current through the string when the switch 2145 is open.

The color point of the string may be set when the string is driven at full current. When the drive current $I_{Total}$ is reduced during dimming, the currents $I_{R1}$, $I_{R2}$, $I_{R3}$; through the resistors $R_1$, $R_2$, $R_3$ remain constant, such that the current through the LED set 2105 is $I_{Total}-I_{R1}$, the current through the LED set 2110 is $I_{Total}-I_{R2}$ and the current through the LED set 2115 is $I_{Total}-I_{R3}$. If the currents $I_{R1}$, $I_{R2}$, $I_{R3}$ through the resistors $R_1$, $R_2$, $R_3$ are 10% of the full drive current, when the drive current is reduced to 50% of full drive current, the fixed currents ($I_{R1}$, $I_{R3}$) become 20% of the total and, therefore, rather than being drive at 50% of their original full drive current, the LED sets 2105, 2110 and 2115 are driven at 40% of their original drive current. In contrast, the red LED sets 2120, 2125 and 2130 are driven at 50% of their original drive current. Thus, the rate at which the current is reduced in the BSY LED sets may be made greater than the rate at which the current is reduced in the red LED sets to compensate for variations in the performance of the LEDs at different drive currents. Such compensation may be used to maintain color point or predictably control color shift over a range of dimming levels.

FIG. 21 also illustrates the use of timer circuit 2140 with a thermistor 2150 being utilized to vary the duty cycle of the timer circuit 2140 that drives the switch 2145. As temperature increases, the time the switch 2145 is on may be decreased to compensate for the reduction in red LED performance with temperature.

In the drawings and specification, there have been disclosed typical embodiments of the present inventive subject matter and, although specific terms are employed, they are used in a generic and descriptive sense only and not for purposes of limitation, the scope of the present inventive subject matter being set forth in the following claims.

That which is claimed is:

1. A lighting apparatus comprising:

a string comprising at least two light emitting device sets serially connected across one voltage source and configured to produce respective light outputs with respective different characteristics, each set comprising at least one light emitting device and the string configured to combine the light outputs of the light emitting device sets to produce a combined light output; and at least one controllable bypass circuit configured to variably bypass current around at least one light emitting device of a set of the at least two light emitting device sets responsive to a string current sensor signal to control a characteristic of the combined light output, wherein the at least one controllable bypass circuit comprises at least two controllable bypass circuits connected in parallel with one another and in parallel with the at least one light emitting device and configured to variably bypass current around the at least one light emitting device responsive to respective control inputs.

2. The apparatus of claim 1, wherein the at least one controllable bypass circuit comprises:

a switch configured to couple and decouple circuit nodes connected to the at least one light emitting device; and a PWM controller circuit configured to operate the switch responsive to the string current sensor signal.

3. The apparatus of claim 1, wherein the string comprises a single string comprising the at least two light emitting device sets, and wherein the at least one controllable bypass circuit is configured to variably bypass the current from a first node of the single string, around the at least one light emitting device, to a second node of the single string, responsive to the string current sensor signal.

4. A lighting apparatus comprising:

a string comprising at least two light emitting device sets serially connected across one voltage source and configured to produce respective light outputs with respective different characteristics, each set comprising at least one light emitting device and the string configured to combine the light outputs of the light emitting device sets to produce a combined light output; and at least one controllable bypass circuit configured to variably bypass current around at least one light emitting device of a set of the at least two light emitting device sets responsive to a string current sensor signal to control a characteristic of the combined light output, wherein the at least one controllable bypass circuit comprises a non-binary variable resistance circuit configured to vary the bypass current responsive to a temperature signal.

5. The apparatus of claim 4, wherein the at least two light emitting device sets includes at least two color point sets.

6. The apparatus of claim 5, wherein the at least two color point sets comprises a set of nominally blue-shifted yellow (BSY) light emitting diodes (LEDs) and a set of nominally red LEDs.

7. The apparatus of claim 6, wherein the at least one controllable bypass circuit is configured to variably bypass current around at least one LED of the set of nominally BSY LEDs.

8. The apparatus of claim 4, wherein the at least one controllable bypass circuit comprises at least two controllable bypass circuits, respective ones of which are configured to variably bypass respective currents around at least one light emitting device of respective ones of the at least two light emitting device sets.

9. The apparatus of claim 4, wherein the at least one controllable bypass circuit is configured to be powered via at least one node of the string.

10. The apparatus of claim 9, wherein the at least one controllable bypass circuit is configured to be powered by a forward voltage across at least one light-emitting device in the string.

11. The apparatus of claim 4, wherein the at least one controllable bypass circuit comprises a communications circuit configured to receive the string current sensor signal via the string.

12. A lighting apparatus comprising:

a string comprising at least one LED; and at least one controllable bypass circuit configured to variably bypass current around the at least one LED responsive to a control input, the at least one controllable bypass circuit configured to conduct bypass current via a series combination of a switch and at least one ancillary diode coupled in parallel with the at least one LED, the at least one ancillary diode having a different forward voltage characteristic than the at least one LED.

13. The apparatus of claim 12:

wherein the string comprises at least two serially-connected LED sets, each set comprising at least one LED; and wherein the at least one LED comprises at least one LED of a set of the at least two LED sets.

14. The apparatus of claim 12, wherein the control input comprises a temperature input, a string current sense input and/or an adjustment input.

15. The apparatus of claim 12, wherein the at least one ancillary diode comprises at least one ancillary LED.

16. The apparatus of claim 15, wherein the at least one ancillary LED has a different color point than the at least one LED.

17. The apparatus of claim 12, wherein the at least one ancillary diode is configured to emit non-visible electromagnetic radiation.

18. The apparatus of claim 12, wherein the at least one controllable bypass circuit comprises:

a PWM controller circuit configured to operate the switch responsive to the control input.

19. The apparatus of claim 12, wherein the at least one controllable bypass circuit is configured to be powered via at least one node of the string.

20. The apparatus of claim 19, wherein the at least one controllable bypass circuit is configured to be powered by a forward voltage across the at least one ancillary diode.

21. The apparatus of claim 12, wherein the at least one controllable bypass circuit comprises at least two controllable bypass circuits, respective ones of which are configured to variably bypass respective currents around respective at least one LEDs.

22. The apparatus of claim 12, wherein the at least one controllable bypass circuit comprises at least two controllable bypass circuits connected in parallel with one another and in parallel with the at least one LED and configured to variably bypass current around the at least one LED responsive to respective control inputs.

23. The apparatus of claim 12, wherein the at least one controllable bypass circuit comprises a non-binary variable resistance circuit.

24. The apparatus of claim 12, wherein the control input comprises a fixed input that establishes an initial color point light output of the apparatus.

25. A method of operating a lighting apparatus comprising a string comprising at least two light emitting device sets serially connected across one voltage source and configured to produce light outputs with respective different characteristics, each set comprising at least one light emitting device and the string configured to combine the light outputs of the light emitting device sets to produce a combined light output, the method comprising:

bypassing current around at least one light emitting device of a set of the at least two light emitting device sets responsive to a string current sensor signal to control a characteristic of the combined light output, wherein bypassing current around at least one light emitting device of a set of the at least two light emitting device sets responsive to the string current sensor signal to control a characteristic of the combined light output comprises controlling a switch and/or a variable resistance circuit connected in parallel with the at least one light emitting device responsive to the string current sensor signal, and wherein controlling a switch and/or a variable resistance circuit connected in parallel with the at least one light emitting device further comprises controlling the switch and/or the variable resistance circuit responsive to a temperature and/or an adjustment input.

26. The method of claim 25, wherein the at least two light emitting device sets includes at least two color point sets.

27. The method of claim 26, wherein the at least two color point sets comprises a set of nominally blue-shifted yellow (BSY) light emitting diodes (LEDs) and a set of nominally red LEDs.

28. The method of claim 27, wherein bypassing current around at least one light emitting device of a set of the at least two light emitting device sets responsive to the string current sensor signal to control a characteristic of the combined light output comprises bypassing current around at least one LED of the set of nominally BSY LEDs.

29. The method of claim 27, wherein bypassing current around at least one light emitting device of a set of the at least two light emitting device sets responsive to the string current sensor signal to control a characteristic of the combined light output comprises bypassing respective currents around at least one light emitting device of respective ones of the at least two light emitting device sets.

30. The method of claim 25, wherein bypassing current around at least one light emitting device of a set of the at least two light emitting device sets responsive to the string current sensor signal to control a characteristic of the combined light output comprises bypassing current around the at least one light emitting device via respective bypass paths responsive to respective control inputs.

31. The method of claim 25, further comprising varying the string current sensor signal to adjust a color point of the combined light output.

32. A method of operating a lighting apparatus comprising a string comprising at least one LED, the method comprising:

bypassing current around the at least one LED via a series combination of a switch and at least one ancillary diode having a different forward voltage characteristic than the at least one LED responsive to a control input.

33. The method of claim 32, wherein the control input comprises a temperature input, a string current sense input and/or an adjustment input.

34. The method of claim 32, wherein the at least one ancillary diode comprises at least one ancillary LED.

35. The method of claim 32, wherein the at least one ancillary diode is configured to emit non-visible electromagnetic radiation.

36. The method of claim 32, wherein bypassing current around the at least one LED via at least one ancillary diode having a different forward voltage characteristic than the at least one LED comprises variably conducting current through the ancillary diode using a switch and/or a variable resistance circuit.

37. The method claim 32, further comprising varying the control input to adjust a color point of the string.

* * * * *